US007048596B2

(12) United States Patent
Swearingen et al.

(10) Patent No.: US 7,048,596 B2
(45) Date of Patent: May 23, 2006

(54) ELECTRICAL CONNECTOR GRID ANCHOR AND METHOD OF MAKING THE SAME

(75) Inventors: Dean D. Swearingen, deceased, late of Clinton Township, MI (US); by Judith J. Swearingen, legal representative, Clinton Township, MI (US); Michael E. Uppleger, Marine City, MI (US)

(73) Assignee: KonneKtech, Ltd., Wallingford, CT (US)

( * ) Notice: Subject to any disclaimer, the term of this patent is extended or adjusted under 35 U.S.C. 154(b) by 182 days.

(21) Appl. No.: 10/274,202

(22) Filed: Oct. 18, 2002

(65) Prior Publication Data

US 2003/0077950 A1 Apr. 24, 2003

Related U.S. Application Data

(60) Provisional application No. 60/330,188, filed on Oct. 18, 2001.

(51) Int. Cl.
*H01R 13/187* (2006.01)

(52) U.S. Cl. ..... 439/843; 439/844

(58) Field of Classification Search ..... 439/843, 439/844, 845, 846, 847
See application file for complete search history.

(56) References Cited

U.S. PATENT DOCUMENTS

| | | | | |
|---|---|---|---|---|
| 1,833,145 | A | 11/1931 | Wilhelm | |
| 3,396,364 | A | 8/1968 | Bonhomme | 339/217 |
| 3,470,527 | A | 9/1969 | Bonhomme | 339/256 |
| 3,517,374 | A | 6/1970 | Bonhomme | 339/176 |
| 3,557,428 | A | 1/1971 | Bonhomme | 29/203 |
| 3,626,361 | A | 12/1971 | Bonhomme | 339/217 |
| 3,641,483 | A | 2/1972 | Bonhomme | 339/217 |
| 3,686,622 | A | 8/1972 | Bonhomme | 339/217 |
| 3,808,589 | A | 4/1974 | Bonhomme | 339/217 |
| 3,858,962 | A | 1/1975 | Bonhomme | 339/256 |
| 4,128,293 | A | 12/1978 | Paoli | 339/258 |
| 4,175,821 | A | 11/1979 | Hunter | 339/258 |
| 4,203,647 | A | 5/1980 | Bonhomme | 339/256 |
| 4,657,335 | A | 4/1987 | Koch et al. | 339/256 |
| 4,720,157 | A | 1/1988 | Nestor et al. | 438/851 |
| 4,734,063 | A | 3/1988 | Koch et al. | 439/844 |
| 4,840,587 | A | 6/1989 | Lancella | 439/851 |
| 4,902,235 | A | 2/1990 | Tonooka | 439/72 |
| 5,033,982 | A | 7/1991 | Lucas | 439/750 |
| 5,108,318 | A | 4/1992 | Sakurai et al. | 439/744 |
| 5,147,229 | A | 9/1992 | Nestor | 439/843 |

(Continued)

FOREIGN PATENT DOCUMENTS

GB 1136589 12/1968

(Continued)

OTHER PUBLICATIONS

Hypertac Interconnect; Rail Traction.

(Continued)

*Primary Examiner*—Thanh-Tam Le
(74) *Attorney, Agent, or Firm*—Blank Rome LLP

(57) ABSTRACT

An electrical connector and method of making same includes a bore extending from an open first end of a housing to an opposed second end. An electrical contact formed of a plurality of contact strips with opposed angularly offset ends and fixedly secured in electrical contact with the housing in the angularly offset position by an internal end anchor and an external end anchor. In one aspect, detents are formed in at least one of the contact strips to engage a complimentary recess in a conductive member insertable into the bore and contact to releasably retain the conductive member in the housing.

45 Claims, 25 Drawing Sheets

U.S. PATENT DOCUMENTS

| | | | | |
|---|---|---|---|---|
| 5,199,909 | A | 4/1993 | Molitor et al. | 439/843 |
| 5,203,813 | A * | 4/1993 | Fitzsimmons et al. | 29/876 |
| 5,326,289 | A | 7/1994 | Leisey | 439/851 |
| 5,378,552 | A | 1/1995 | Dixon et al. | 429/91 |
| 5,416,286 | A | 5/1995 | Dixon et al. | 200/16 |
| 5,474,479 | A * | 12/1995 | Bennett et al. | 439/843 |
| 5,511,307 | A | 4/1996 | Reiersgaard et al. | 29/863 |
| 5,607,328 | A | 3/1997 | Joly | 439/852 |
| 5,662,497 | A | 9/1997 | Reilly | 439/627 |
| 5,735,716 | A | 4/1998 | Bilezikjian | 439/843 |
| 6,250,974 | B1 | 6/2001 | Kerek | 439/842 |

FOREIGN PATENT DOCUMENTS

| | | |
|---|---|---|
| GB | 2065993 | 7/1981 |
| WO | WO 98/43321 | 10/1998 |

OTHER PUBLICATIONS

Hypertac Interconnect; Connel.
Hypertac Interconnect; FRB Connectron; Apr. 1999.

* cited by examiner

ELECTRICAL CONNECTOR GRID ANCHOR AND METHOD OF MAKING THE SAME

CROSS REFERENCE TO CO-PENDING APPLICATION

This application claims the benefit of the filing date of co-pending U.S. provisional patent application Ser. No. 60/330,188, filed Oct. 18, 2001, the contents of which are incorporated herein in its entirety.

BACKGROUND

The present invention relates, in general, to electrical connectors and, more specifically, to radially resilient electrical sockets, also referred to as barrel terminals, in which a cylindrical electrical prong or pin is axially inserted into a socket whose interior surface is defined by a plurality of contact strips or wires mounted within a cylindrical sleeve and inclined between angularly offset ends.

Radially resilient electrical sockets or barrel terminals are a well known type of electrical connector as shown in U.S. Pat. Nos. 4,657,335 and 4,734,063, both assigned to the Assignee of the present invention.

In such electrical sockets or barrel terminals, a generally rectangular stamping is formed with two transversely extending webs spaced inwardly from and parallel to opposite end edges of the sheet. Between the inner side edges of the transverse web, a plurality of uniformly spaced, parallel slots are formed to define a plurality of uniformly spaced, parallel, longitudinally extending strips which are joined at opposite ends to the inward side edges of both transverse webs. Other longitudinally extending slots are coaxially formed in the sheet and extend inwardly from the end edges of the blank to the outer side edges of the transverse webs to form a plurality of uniformly spaced, longitudinally extending tabs projecting outwardly from each transverse web.

The blank or sheet is then formed into a cylinder with the longitudinal strips extending parallel to the axis of the now cylindrical sheet. A closely fitting cylindrical sleeve is slipped coaxially around the outer periphery of the cylindrical blank, and extends axially substantially between the outer edges of the transverse webs. The mounting tabs at each end of the blank are then bent outwardly across end edges of the sleeve into radially extending relationship to the sleeve.

A relatively tight-fitting annular collar or outer barrel is then axially advanced against the radially projecting tabs at one end of the sleeve and slipped over the one end of the sleeve driving the tabs at that end of the sleeve downwardly into face-to-face engagement with the outer surface of the one end of the sleeve. The fit of the annular collar to the sleeve is chosen so that the end of the cylindrical blank at which the collar is located is fixedly clamped to the sleeve against both axial or rotary movement relative to the sleeve. A tool typically having an annular array of uniformly spaced, axially projecting teeth is then engaged with the radially projecting tabs at the opposite end of the sleeve. The teeth on the tool are located to project axially between the radially projecting tabs closely adjacent to the outer surface of the cylindrical sleeve. The tool is then rotated about the longitudinal axis of the cylindrical sleeve while the sleeve is held stationary to rotatably displace the engaged tabs approximately 15° to 45° from their original rotative orientation relative to the sleeve and the bent over tabs at the opposite end of the sleeve. The tool is then withdrawn and a second annular collar or outer barrel is force fitted over the tabs and the sleeve to fixedly locate the opposite end of the blank in a rotatably offset position established by the tool. When completed, such an electrical socket has longitudinal strips extending generally along a straight line between the angularly offset locations adjacent the opposite ends of the cylindrical sleeve. The internal envelope cooperatively defined by the longitudinal strips is a surface of revolution coaxial to the axis of the cylindrical sleeve having equal maximum radii at the points where the strips are joined to the respective webs and a somewhat smaller radius midway of the length of the strips. The minimum radius, midway between the opposite ends of the strips, is selected to be slightly less than the radius of a cylindrical connector pin which is to be inserted into the barrel socket so that the insertion of the pin requires the individual longitudinal strips to stretch slightly longitudinally to firmly frictionally grip the pin when it is seated within the barrel socket.

To put it another way, because of the angular offset orientation of the opposed ends of each of the strips, each strip is spaced from the inner wall of the sleeve in a radial direction progressively reaching a maximum radial spacing with respect to the outer sleeve midway between the ends of the sleeve.

Such a radially resilient electrical barrel socket provides an effective electrical connector which provides secure engagement with an insertable pin; while still enabling easy manual withdrawal or insertion of the pin relative to the socket. Such connectors also provide a large electrical contact area between the pin and the socket which enables such connectors to be employed in high current applications.

It is also known to construct such an electrical connector in a manner in which one of the collars is formed as an integral part or extension of a support member forming a part of the overall connector. The afore-described assembly process remains the same except that the separate collars at both ends of the socket are replaced by one collar at one end and a hollow, cylindrical extension of a connector which can be inserted into or otherwise electrically connected to an electrical device, such as a vehicle alternator, etc. The hollow cylindrical end of the support receives and holds the tabs at the first end of the sleeve tight against rotation while the opposing tabs are angularly rotated. A collar or end cap is then clamped over the rotated tabs to maintain such tabs in the rotated position.

However, it is believed that further modifications or enhancements could be made to such radially resilient electrical sockets to reduce the manufacturing cost as well as to simplify the mounting or attachment of such sockets or terminals to an electrical device to which they are to be electrically connected.

SUMMARY

The present invention is an electrical connector for connecting first and second electrically conductive elements and a method of manufacturing same.

In one aspect, the present invention is a method of manufacturing the electrical connector including the steps of forming a cylindrical contact with a plurality of spaced contact strips, each having first and second ends extending between opposite ends of the contact, inserting the contact into an open end of a bore of a housing to a second end of the bore, inserting a member in the bore, forcibly fixing the member with respect to the housing to stationarily position the second ends of the contact strips in electrical contact with the housing, angularly offsetting the first and second ends of each contact strip from each other and fixing first ends of the contact strips to form each contact strip in a hyperbolic profile between the first and second ends.

In another aspect, the present invention is an electrical connector including a housing having a bore extending from a first end of the housing to a second end, a contact formed of a plurality of elongated contact strips mounted in the bore in the housing, the contact having first and second ends wherein the first and second ends are angularly offset to form each contact strip in a hyperbolic profile between the first and second ends, external end anchor means for fixedly connecting the first ends of the contact to the first end of the housing, and internal anchor means for fixedly connecting the second ends of the contact internally to the housing.

A plurality of different internal end anchors and external end anchors are disclosed as part of the invention. Each of internal end anchors are interchangeably usable with any of the external anchors.

A detent contact strip construction is provided for increasing the pull-out force of the connector to securely retain a conductive member insertable into the housing of the electrical connector.

The various internal end anchors and the external end anchors disclosed as part of the present invention enable an electrical contact having angularly offset ends defining individual contact strips of the contact in a hyperbolic profile to be easily mounted in a bore in a housing having a mostly closed inner end. The internal end anchors secure the innermost ends of the contact in a fixed position by stationarily and electrically engaging the second ends of the contact strips with the housing. The external end anchors secure the first ends of the contact strips in a stationary, fixed position with respect to the housing and, at the same time, in the angularly offset position with respect to the opposed second ends of the contact strips.

BRIEF DESCRIPTION OF THE DRAWING

The various features, advantages and other uses of the present invention will become more apparent by referring to the following detailed description and drawing in which.

DETAILED DESCRIPTION

The structure of a barrel socket used in an electrical connector according to one aspect of the present invention is best explained by a description of the manner in which it is manufactured.

Figure 1:
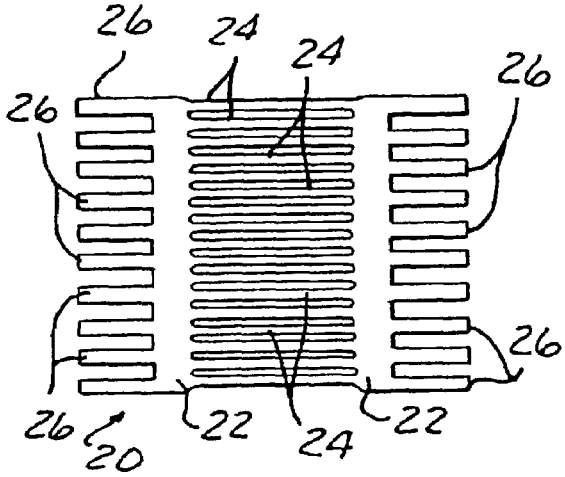
FIG. 1 PRIOR ART
FIG. 1 is a plan view of a flat sheet metal blank employed in constructing a prior art barrel terminal.

The first step in the manufacture of the barrel socket is the stamping of a blank in the form shown in FIG. 1 from a flat piece of sheet metal which preferably is a beryllium copper alloy which has both mechanical and electrical properties well adapted for this application.

Referring to FIG. 1, the blank designated generally 20 is stamped in a generally rectangular configuration and formed with a pair of spaced, parallel, transversely extending connecting web portions 22 which are integrally connected to each other by a plurality of uniformly spaced, parallel, longitudinally extending strips 24 which extend between the respective inner edges of the webs 22. A plurality of spaced, parallel tabs 26 project longitudinally outwardly from the outer edges of the respective transverse webs 22.

Figure 2:
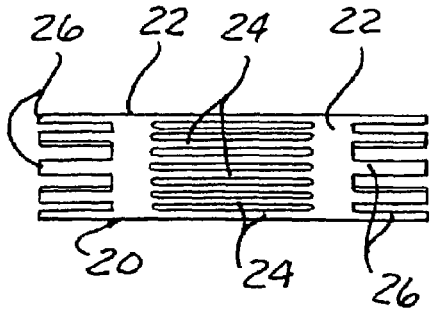
FIG. 2 PRIOR ART
FIG. 2 is a side elevational view of the blank of FIG. 1 formed into a cylinder.

The second step in the manufacturing process is shown in FIG. 2 and finds the blank 20 formed into a horizontal, cylindrical, tubular configuration, the axis of the cylindrical tube extending parallel to the longitudinal strips 24 and tabs 26.

Figure 3:
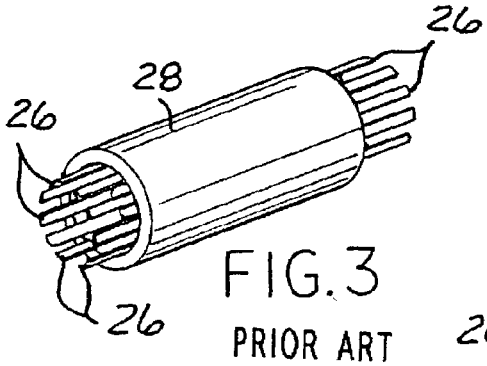
FIG. 3 PRIOR ART
FIG. 3 is a perspective view showing a close fitting cylindrical sleeve disposed about the blank of FIG. 2.

After the blank 20 is formed into the cylindrical tubing configuration of FIG. 2, a close-fitting cylindrical sleeve 28 is slipped over the tube as shown in FIG. 3, the axial length of sleeve 28 being sufficient to extend over both of transverse webs 22 leaving the tabs 26 projecting outwardly from the opposite ends of sleeve 28.

Figure 4:
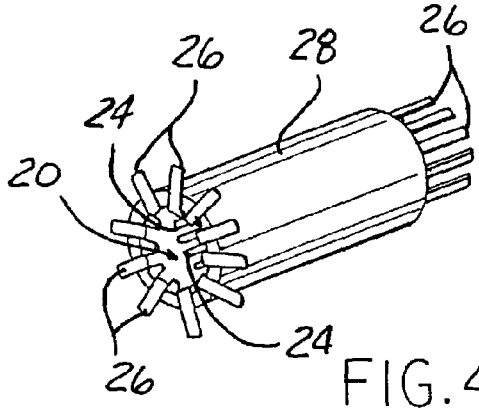
FIG. 4 PRIOR ART
FIG. 4 is a perspective view of a subsequent step in the construction of the barrel terminal.

In the next step shown in FIG. 4, the projecting tabs 26 are flared or bent outwardly across one end edge of sleeve 28 to project radially outwardly of the axis of the sleeve.

Figure 5:
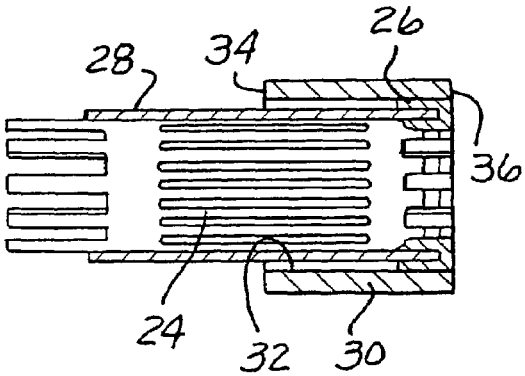
FIG. 5 PRIOR ART
FIG. 5 is an enlarged side elevational, cross-sectional view showing a subsequent step in the construction method.

In the next step of the process shown in FIG. 5, a temporary first housing or fixture 30 has a central bore 32 extending at least from a first end 34 to an opposite end 36. The bore 32 has a diameter larger than the diameter of the cylindrical sleeve 28 by a distance equal to the thickness of the tabs 26. The first housing 30 is axially driven over one end of the sleeve 28 or the sleeve 28 is axially driven into one of the first and second ends 34 and 36 of the first housing 30. The forcible interconnection of the sleeve 28 and the first housing 30 bends the radially flared tabs 26 at the one end of the sleeve 28 back on themselves into overlapping, face-to-face relationship with the outer surface of the sleeve 28. The inner diameter of the bore 32 is chosen such that when the first housing 30 and the first end of the blank 20 and the sleeve 28 are in the position shown in FIG. 5, the first housing 30 exerts sufficient force on the tabs 26 to clamp the tabs 26 against the outer surface of the sleeve 28 to prevent any axial or rotary movement of the tabs 26 relative to the sleeve 28.

Figure 6:
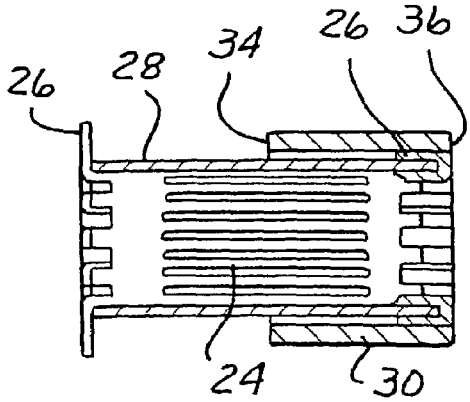
FIG. 6 PRIOR ART
FIG. 6 is an enlarged side elevational, cross-sectional view showing yet another step in the construction method.

Next, as shown in FIG. 6, the tabs 26 at the opposite end of the sleeve 28 are flared or bent radially outwardly across the opposite end edge of the sleeve 28 to project radially outward from the axis of the sleeve 28.

Figure 7:
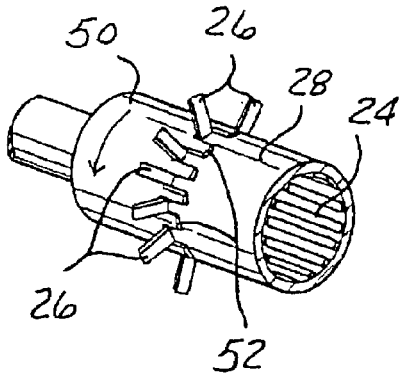
FIG. 7 PRIOR ART
FIG. 7 is a perspective view depicting another step in the construction method.

In the next step shown in FIG. 7, a tubular tool 50 having uniformly spaced, axially projecting teeth 52 on one end is engaged with the radially projecting tabs 26 projecting out of one end of the sleeve 28. The internal diameter of the tool 50 is such that it will have a loose, sliding fit with the outer diameter of the sleeve 28 and the teeth 52 are so spaced from each other so as to project through the spaces between the adjacent, radially projecting tabs 26.

When the tool 50 is seated with the teeth 52 between the radially projecting tabs 26, the first housing 30 is clamped or otherwise held against rotation and the tool 50 rotated coaxially of the sleeve 28 through a predetermined angle, which is typically from about 15° to about 45°. This action of the tool 50 rotatably offsets one end of the blank or sheet 20 from the previously fixed end held against rotation by the first housing 30 relative to the sleeve 28. The characteristics of the beryllium copper alloy of which the blank or sheet 20 is preferably made is such that, although the material possesses some resiliency, the rotation imparted by the tool 50 permanently sets the blank 20 in the rotated position.

Figure 8:
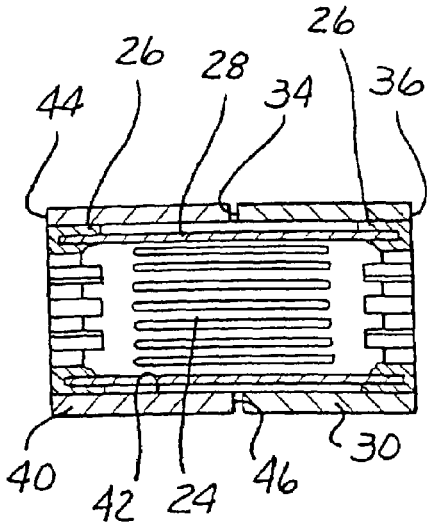
FIG. 8 PRIOR ART
FIG. 8 is a side elevational, longitudinal cross-sectional view of the final assembled state of the barrel terminal.

Next, as still shown in FIG. 8, a second housing 40 also having a through bore 42 extending from a first end 44 to an opposed second end 46 is axially driven over the sleeve 28 into interference with the radially outward extending tabs 26 or the ends of the sleeve 28 and the blank 20 extending outward from the first housing 30 are axially driven into the bore 42 in the second housing 40. The second housing 42 is then advanced relative to the first housing 30 to force fit the interior surfaces of the bore 42 in the second housing 40 into engagement with the radially extending, angularly offset tabs 26 thereby bending the tabs 26 over into face-to-face engagement with the outer surface of the other end of the sleeve 28.

The second housing 40 and the first housing 30 are advanced relative to one another into abutment to hold the angularly offset tabs 26 at each end of the sleeve 28 non-movably against the outer surface of the sleeve 28.

However, the above-described barrel terminal has opposed open ends allowing access to the tabs 26 on the blank or grid 20 from either end to perform the above-described bending, inserting and locking operations.

Figure 9:
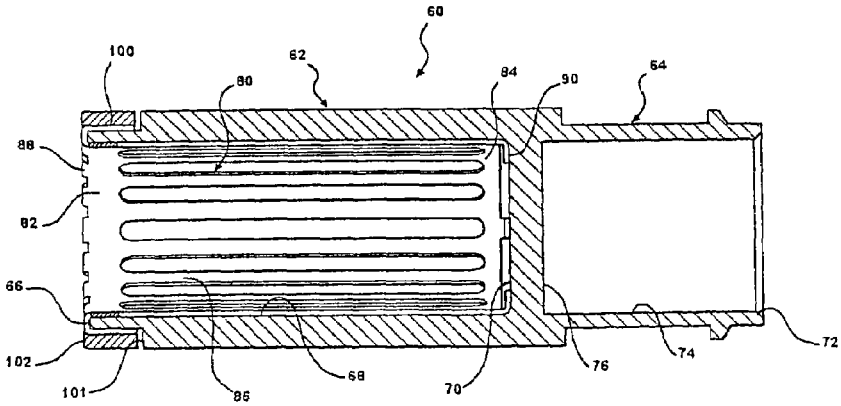
FIG. 9 is a longitudinal cross-sectional view of a prior art connector having a barrel terminal constructed according to the present invention mounted therein.

According to one aspect of the present invention, a modified barrel terminal is mounted in a terminal housing 60 shown in FIG. 9 and having a barrel terminal receiving portion or body 62 and a contiguous, generally axially or angularly spaced conductor or pin receiving portion 64. Thus, although the barrel terminal receiving portion or housing 62 is shown axially aligned with pin or conductor receiving portion or body 64, it will be understood that the two body portions 62 and 64, while contiguous or connected, can be disposed at any angular orientation, such as a 45°, 90°, etc.

According to the present invention, the barrel terminal receiving portion or body 62 has a first open end 66 which is hereafter defined as a "first or external end". A bore 68 extends from the first external end 66 to an internal wall 70, hereafter also referred to as a "blind end".

The pin receiving body 64 likewise has a first open end 72 and a through bore 74 extending from the first open end 72 to an internal wall 76. The bore 74 is configured for receiving a pin or conductor in an electrical connection.

In addition, the pin receiving body 64 can also be configured as part of an electrical use device, such as a battery wherein the body 64 is formed as an integral part of the battery within an internal electrical connection made by appropriate means to the body 64.

The terminal housing 60 shown in FIG. 9, can be produced from either stamped parts formed from flat metal stock and then formed into the desired cylindrical configuration or machined from metal bar stock.

A barrel terminal 80 constructed according to any one of several different methodologies is mountable in the bore 68 of the barrel terminal body 62. As described in greater detail hereafter, the barrel terminal 80 is formed of a stamped grid having webs 82 and 84 at opposite ends of a plurality of interconnecting strips 86. Tabs 88 extend oppositely from the webs 82 and 84, respectively, and are secured in place to the barrel terminal body 62 by external end anchors and internal end anchors described hereafter. After the strips 86 have been angularly offset from end to end to dispose each strip in a hyperbolic shape from end to end having a smaller internal diameter at a generally center point than the nominal, non-hyperbolic state of the strips 82. This diameter is typically smaller than the outer diameter of a pin or conductor inserted into the barrel terminal 80 so as to provide a secure electrical contact between the barrel terminal and the inserted pin as well as a high pin pull-out retention force.

Alternately, the strips 86 of the barrel terminal 80 can be replaced by individual wires which are initially held in place by narrow neck portions or ribs between opposite ends of the wires which are separated during the hyperbolic angular offset process. The ends of each of the wires then act as the tabs for securement to the barrel terminal body 62 by the external and internal anchors described hereafter. Such a wire arrangement will also be understood to constitute a "grid" as the term is used herein. As also described hereafter, several aspects of the barrel terminal 80 may not require tabs at either the external or internal end of the barrel terminal 80.

External Grid Anchor

The following description will encompass several different aspects of an external grid anchor used to fixedly mount one end of the barrel terminal 80 in a fixed position relative to the barrel terminal body 62 after the hyperbolic angular offset is applied to the strips 86 of the barrel terminal 80 which is only partially illustrated in the following figures.

Figure 10:
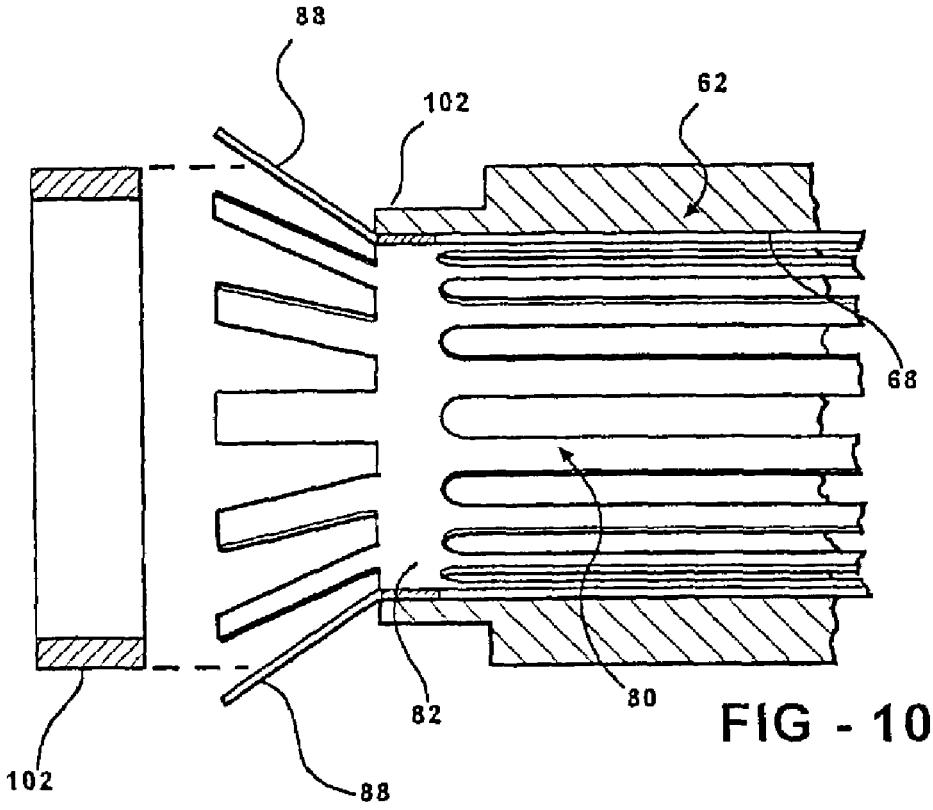
FIG. 10 is a partial, exploded, longitudinal cross-sectional view showing a step in the assembly of the barrel terminal shown in FIG. 9.
Figure 11:
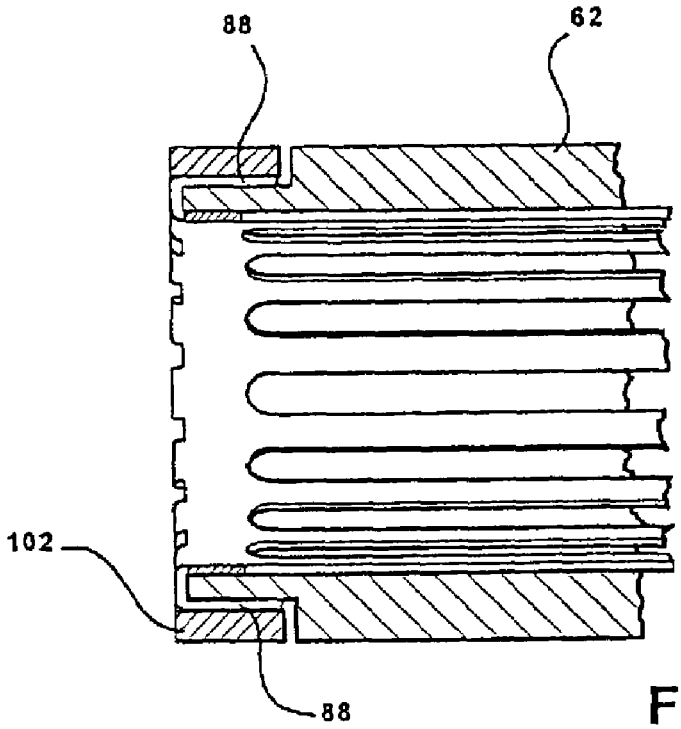
FIG. 11 is a longitudinal cross-sectional view of the completed external grid anchor end of the barrel terminal shown in FIG. 9.

One aspect of the external grid anchor employed to fixedly mount the external end of the barrel terminal 80 in the barrel terminal body 62 is shown in FIGS. 9, 10, and 11. In FIG. 9, the external end 66 of the barrel terminal body 62 has a necked down end 100 of a smaller diameter than the outer diameter of the remainder of the barrel terminal body 62. In the aspect shown in FIGS. 10 and 11, the end 101 of the wall of the barrel terminal body 62 is contiguous with (at the same or at a smaller diameter) the remainder of the sidewall of the barrel terminal 62. An external band sleeve or anchor 102 is then forced over the bent ends of the barrel terminal 80.

FIG. 10 shows an initial assembly step wherein the barrel terminal 80 is inserted into the bore 68 in the barrel terminal body 62. The tabs 88 are bent or flared angularly outward in an approximate 30°–45° angle as shown in FIG. 10. An external sleeve or band 102 in the aspect shown in FIG. 9 is forcibly urged inside of the tabs 88. The band 102 in the aspect shown in FIG. 9 has an inner diameter sized to bend the tabs 88 of the barrel terminal 80 over and into contact with the exterior surface of the necked down end 100 of the barrel terminal body 62 in a secure, press fit. It is believed that a press fit of the band or anchor 102 will be sufficient to retain the tabs 88 in a non-rotative position in the desired angular offset from the tabs on the other end of the barrel terminal 80. If additional non-rotative strength is required, mechanical fastening or forming means may be employed to fix the band 102 in place relative to the external end of the barrel terminal body 62 and the barrel terminal 80 itself.

The external grid anchor shown in FIGS. 12–15 employs a different anchoring technique from the external grid anchors described above. This aspect of the external grid anchor can also be employed as the internal end grid anchor by providing the same louver configuration at the opposite end of the barrel terminal 80. Thus, the following description of a grid anchoring technique in FIGS. 12–17 will be understood to apply equally to both an external grid anchor and an internal grid anchor of the barrel terminal 80.

Figure 12:
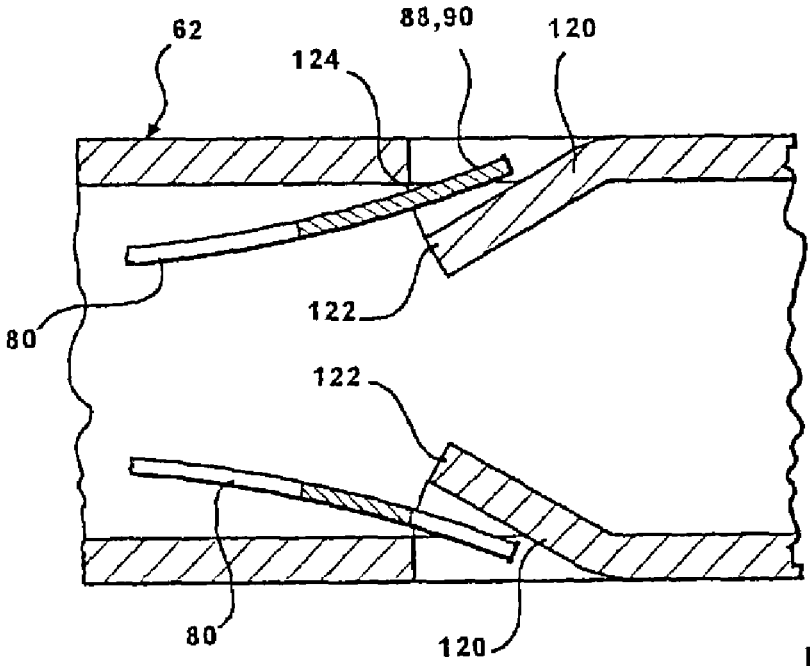
FIG. 12 is an enlarged, longitudinal, cross-sectional view of another aspect of the external grid anchor.
Figure 14:
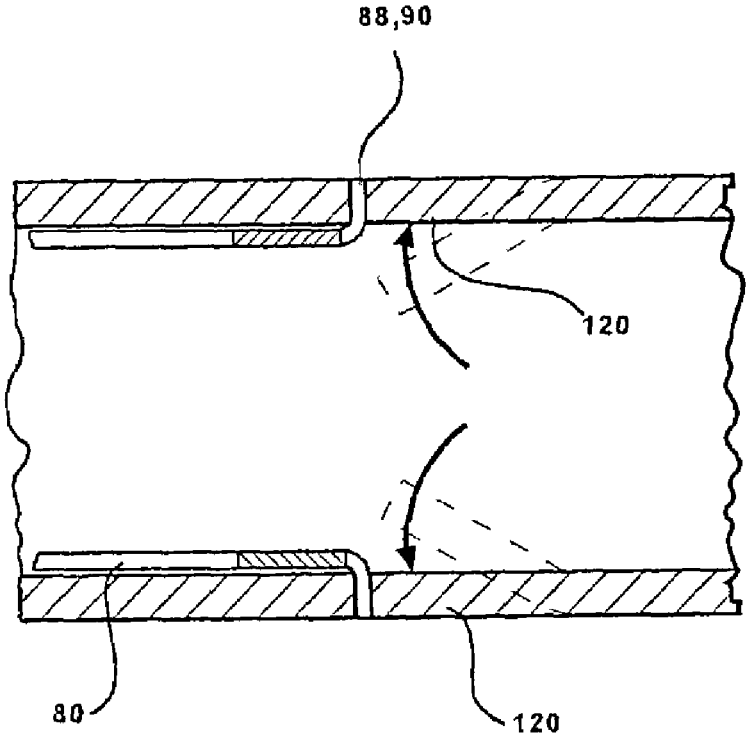
FIG. 14 is a longitudinal cross-sectional view, generally similar to FIG. 13, but showing the completed assembly state of the grid and external anchor according to FIGS. 12 and 13.
Figure 13:
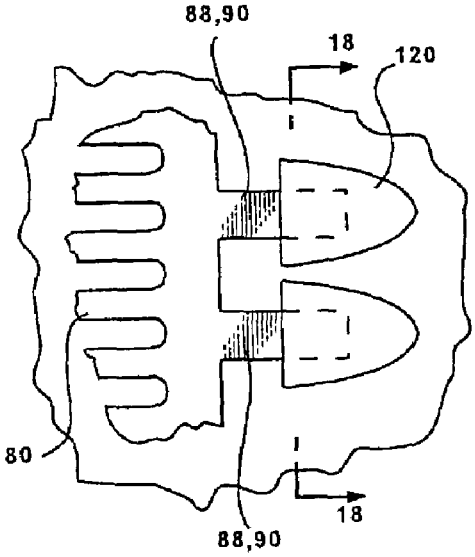
FIG. 13 is a partial plan view of a partial step in the assemble of the grid and external anchor shown in FIG. 12.
Figure 15:
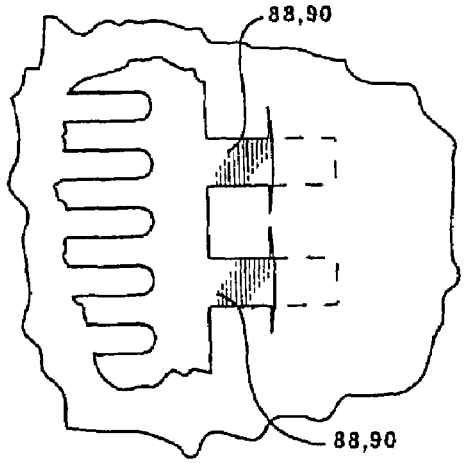
FIG. 15 is a partial plan view of the completed external grid anchor shown in FIG. 14.

As shown in FIGS. 12 and 13, a plurality of so-called "louvers" 120 are formed, such as by stamping, in the outer wall of the barrel terminal body 62. In this aspect of the invention, the louvers 120 are circumferentially aligned in a single circumferential arrangement about the barrel terminal body 62. As shown in FIG. 12, an inner end 122 of each louver 120, after stamping or other formation, will be spaced from an inner edge 124 of an adjacent portion of the side wall of the barrel terminal body 62. The edge 124 is smoothed or rounded so as not to provide a piercing edge on the grid tabs 88 or 90. The tabs 88 or 90 are then inserted through the opening between the inner end 122 of each louver 120 and the adjacent edge 124 of the sidewall of the barrel terminal body 62 as shown in FIG. 12. Next, as seen in FIGS. 14 and 15, a pin or plug, not shown, can be inserted through one end of the barrel terminal body 62 to force the inward angled louvers 120 radially outward into substantial alignment with the sidewall of the barrel terminal body 62. This mechanically swages or deforms the ends of the tabs 88 and 90 in the inner end 122 of each louver 120 into a secure mechanical fit holding the tabs 88 or 90 of the barrel terminal 80 in the desired angular offset position.

Figure 16:
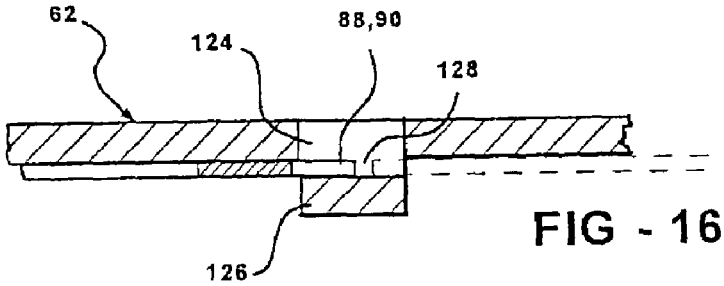
FIGS. 16 and 17 are a partial, longitudinal cross-sectional views, similar to FIG. 12, but showing another aspect of a louver external grid anchor in partially assembled and completely assembled states.
Figure 17:
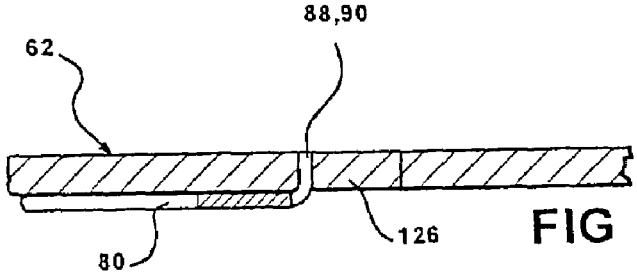
Figure 18:
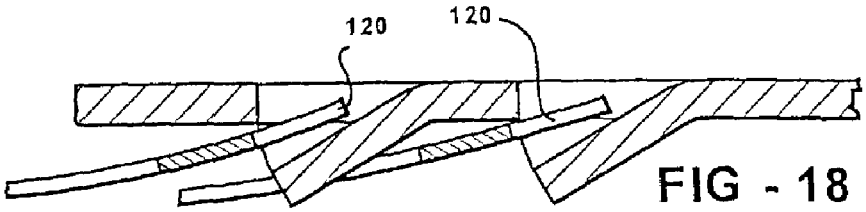
FIG. 18 is a partial, longitudinal cross-sectional view, generally similar to FIG. 12, but showing an alternate aspect of a multi-row louver external grid anchor according to another aspect of the present invention.
Figure 19:
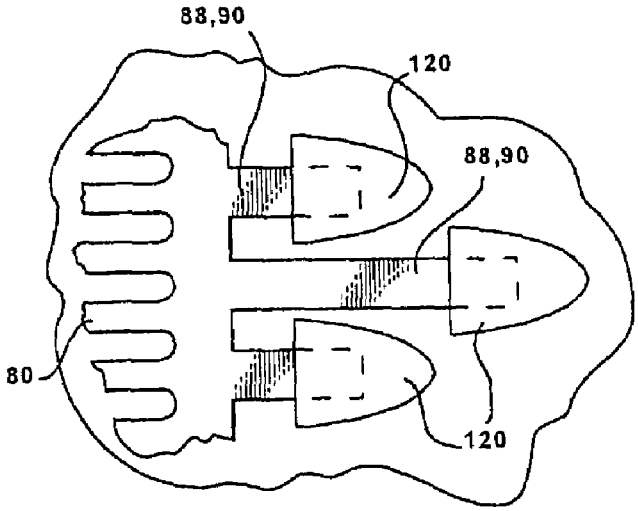
FIG. 19 is a partial, plan view of the partially assembled louver external grid anchor shown in FIG. 18.
Figure 20:
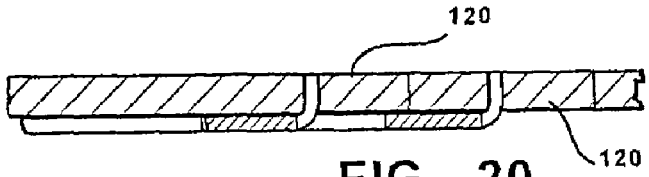
FIG. 20 is a longitudinal cross-sectional view, generally similar to FIG. 18, but showing the external grid anchor of this aspect of the invention in a completed state.

FIGS. 16 and 17 depict an alternate louver construction wherein the louver 120 is formed more as a depression connected by side ribs 128 to the sidewall of the barrel terminal body. The louver 120 remains spaced from the adjacent edge 124 of the sidewall of the barrel terminal body 62 to provide an opening for receiving a tab 88 or 90. A radially outward force exerted on the louver 120 will forcibly urge the louver 120 outward into substantial alignment with the sidewall of the barrel terminal body 62 as shown in FIG. 17 to mechanically deform and fix the tabs 88 or 90 on the barrel terminal 80 in a secure, non-rotatable position.

Figure 21:
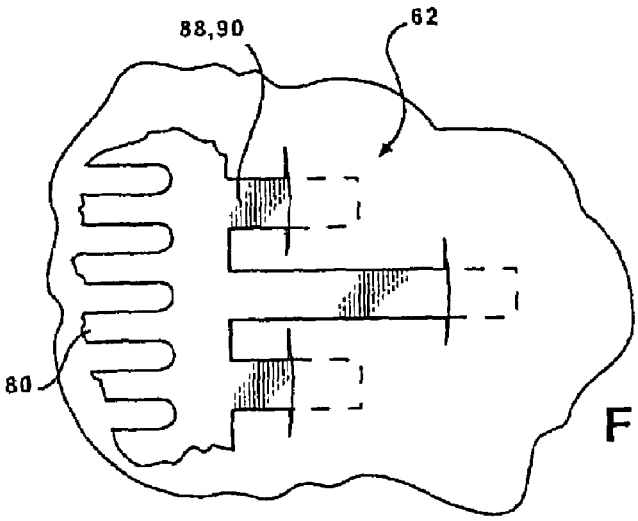
FIG. 21 is a partial plan view of the completed state of the external grid anchor shown in FIG. 20.

An alternate louver configuration for an external grid anchor is shown in FIGS. 18–21. In this aspect of the external grid anchor according to the present invention, the louvers 120 are formed in the same manner as described above and shown in FIGS. 12–15 or in FIGS. 16 and 17, except that the louvers 120 are arranged in a plurality, such as at least two, circumferential bands or rows 132 and 134 about the sidewall of the barrel terminal body 62. Alternating tabs 88 or 90 on the barrel terminal 80 are inserted between selected louvers 120 with any excess length of the tabs 88 or 90 removed for the axially innermost louvers 120. The outward forces is still exerted on the louvers 120 to forcibly bend the louvers 120 radially outward to trap the tabs 88 and 90 between the louvers 120 and the adjacent sidewall of the barrel terminal body 62 as shown in FIG. 21.

Figure 22:
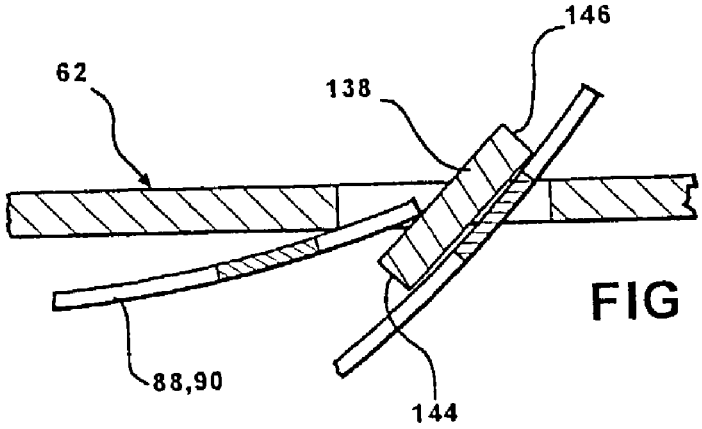
FIG. 22 is a partial, longitudinal cross-sectional view, generally similar to FIG. 12, but showing yet another aspect of a dual row louver external grid anchor according to the present invention shown in a partially assembled state.
Figure 23:
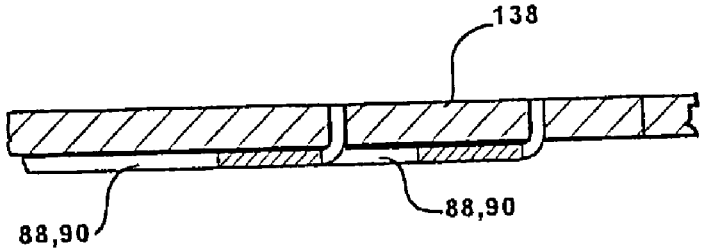
FIG. 23 is a partial, longitudinal cross-sectional view, similar to FIG. 22, but showing the external grid anchor of FIG. 22 in a complete assembled state.
Figure 24:
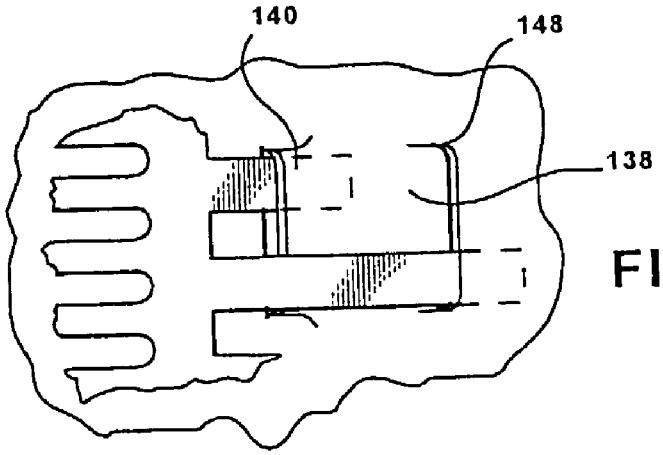
FIG. 24 is a plan elevational view of the completed state of the external grid anchor shown in FIG. 23.

FIGS. 22–24 depict another dual louver external grid or internal grid anchor in which a plurality of circumferentially spaced louvers 138 arranged in a first annular band 140 are formed by suitable forming processes, such as stamping, for example only, into an angular shape with respect to the sidewall of the body 62 of the barrel terminal body 62 such that an inner end 144 projects radially inward from the sidewall barrel terminal body 62 and an outer end 146 initially extends outward from the sidewall of the barrel terminal body 62. This defines two opposed openings between each louver 138 and the adjoining portions of the sidewall of the barrel terminal body 62 which receive two adjacent tabs 88 or 90 between the inner end 144 and the outer end 146 of each louver 138 and the adjoining portions of the sidewall of the barrel terminal body 62. A rotative force from both the inside and outside of the barrel terminal body 62 will cause each louver 138 to rotate into substantial alignment with the sidewall of the barrel terminal body 62 as shown in FIGS. 23 and 24 to mechanically trap and fix the end of each tab 88 or 90 between one louver 138 and the adjoining portions of the sidewall of the barrel terminal body 62. As shown in FIGS. 22–24, alternating tabs 88 or 90 can be disposed in two circumferential bands 140 and 148.

Figure 25:
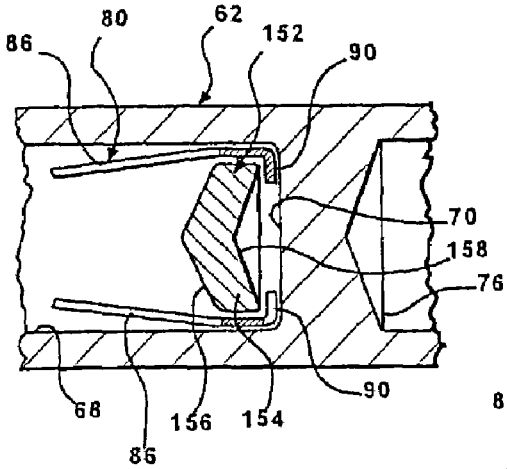
FIGS. 25 and 26 are partial, enlarged, longitudinal cross-sectional views showing another aspect of an internal anchor according to the present invention shown in a partially assembled and completely assembled state, respectively.
Figure 26:
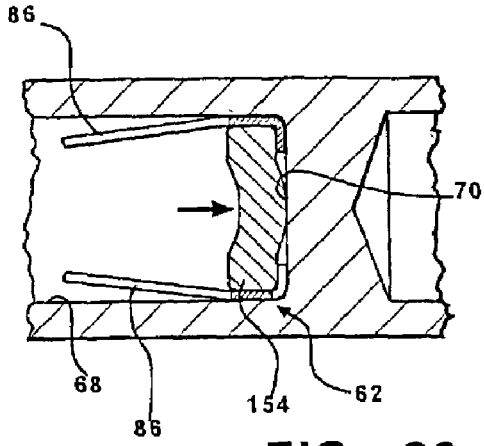

Referring now to FIGS. 25 and 26, there is depicted one aspect of an internal or blind end anchor 152. The anchor 152 is in the form of a conically shaped, annular disc 154 which is preferably formed of a material softer than the material used to form the barrel terminal body 62. As shown in FIG. 25, the disc 154 has a V-shape formed with opposed first and second V-shaped walls 156 and 158.

In this aspect, the tabs 90 are initially pre-bent into an angular or perpendicular shape with respect to the remainder of the strips 86 so as to seat against the internal wall 70 in the bore 68 in the barrel terminal body 62. After the barrel terminal 80 has been inserted into the bore 68, with the tabs 90 disposed adjacent to the internal wall 70, force, by a punch or other tool member inserted into the bore 68 internally of the strips 86 of the barrel terminal 80, is applied in the direction of the arrow in FIG. 26 against the first surface 156 of the disc 154 to deform the V-shaped disc 154 into a generally flat or planar shape shown in FIG. 26. This displaces the softer material of the disc 154 radially and axially outward away from the direction of the applied forced so as to compressively trap the tabs 90 on the barrel terminal 80 against the inner wall 70 and the adjacent sidewalls of the bore 68.

Figure 27:
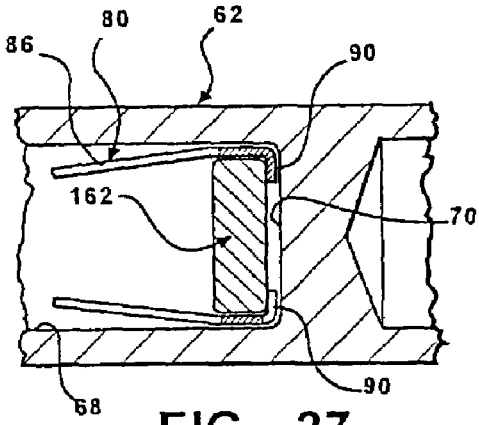
FIGS. 27 and 28 are partial, enlarged, longitudinal cross-sectional views showing another aspect of an internal anchor according to the present invention shown in a partially assembled and completely assembled state, respectively.
Figure 28:
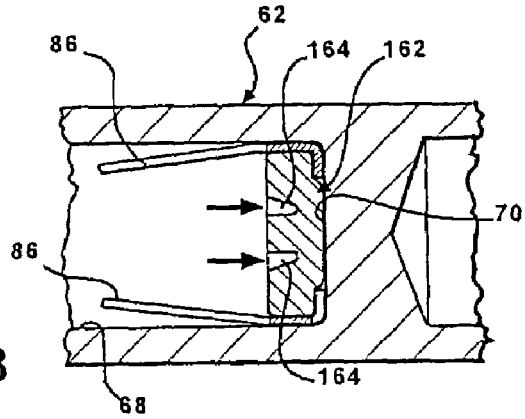

The internal grid anchor 162 shown in FIGS. 27 and 28 is similar to the grid anchor 152 except that the disc-shaped grid anchor 162 initially has a planar, flat shape shown in FIG. 27. This disc-shaped grid anchor 162 is inserted into the bore 68 of the barrel terminal body 62 interiorly of the strips 86 of the barrel terminal against the inward angled tabs 90 at one end of the barrel terminal 80. A V-shaped die or punch, not shown, is then forcibly pressed into one surface of the anchor 162 to displace material of the anchor 162 radially and axially outward from the displaced bore regions 164 formed by the die or punch. The volume of material of the anchor 162 displaced by the punch is driven radially and axially outward locking the tabs 90 and the adjacent ends of the strips 86 to the barrel terminal body 62.

It will be understood that in both of the internal grid anchors 152 and 162, the radial and axial outward expansion of the anchors 152 and 162 can generate enough force to compress the ends of the barrel terminal strips 86 into secure electrical contact with the barrel terminal body 62 to eliminate the need for the angularly bent tabs 90. This means that the ends of the strips 86, which still may be the tabs 90, can remain in a generally linear shape with the remainder of the strips 86 and compressed by the anchors 152 and 162 radially outward against the sidewalls of the bore 68 of the barrel terminal body 62.

Figure 29:
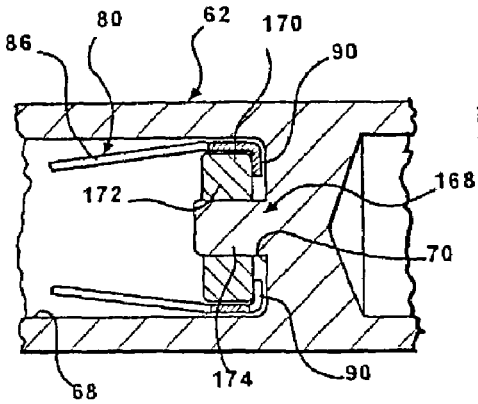
FIGS. 29 and 30 are partial, enlarged, longitudinal cross-sectional views showing another aspect of an internal anchor according to the present invention shown in a partially assembled and completely assembled state, respectively.
Figure 30:
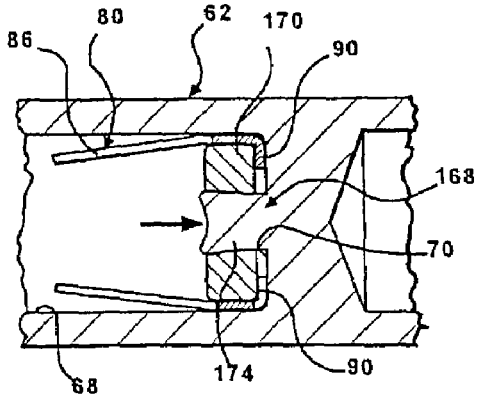

In FIGS. 29 and 30, a different internal grid anchor 168 is depicted. In this aspect of the invention, the internal grid anchor 168 includes a generally flat washer 170 having an central bore or aperture 172 formed therethrough. The aperture 172 in the washer 170 receives a nib or projection 174 which is an integral extension of a solid portion of the barrel terminal body 62 which forms the internal wall 70. The nib 174 initially has a generally cylindrical shape and a diameter to allow the nib 174 to extend easily through the central bore 172 in the washer 170.

During the assembly process, after the barrel terminal 80 has been inserted into the bore 68 in the barrel terminal body 62, with or without the tabs 90 on the strips 86 of the barrel terminal 80 being angularly bent with respect to the remainder of the strips 86, a force is applied in the direction of the arrow in FIG. 30 to the outer surface of the nib 174. This results in outward expansion of the material of the nib 174 causing the nib 174 to mushroom radially outward thereby forcing the perimeter of the washer 170 to expand locking the adjacent portions of the tabs 90 or strips 86 to the walls of the barrel terminal body 62. This radially outward mushrooming of the nib 174 also causes a radial expansion of the outer end surface of the nib 174 over an adjacent portion of the washer 170 adjacent to the bore 172 in the washer 170. This interference prevents linear pull-out of the washer 170 and the barrel terminal 80 from the body 62.

Figure 31:
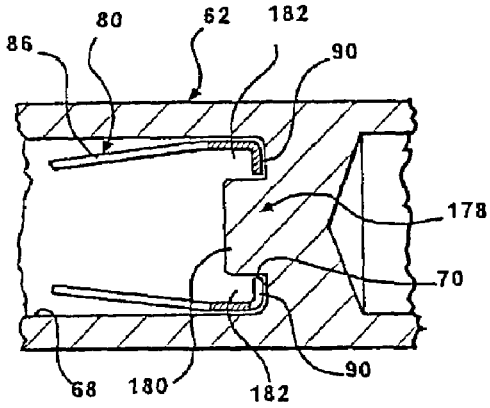
FIGS. 31 and 32 are partial, enlarged, longitudinal cross-sectional views showing another aspect of an internal anchor according to the present invention in a partially assembled and completely assembled state, respectively.
Figure 32:
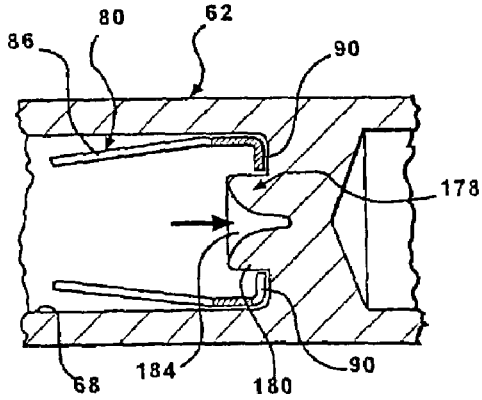

A similar, yet modified internal grid anchor 178 is shown in FIGS. 31 and 32. The internal grid anchor 178 also includes an initially cylindrical nib 180 projecting away from the internal wall 70 in a central portion of the barrel terminal body 62. The outer periphery of the nib 180 forms a peripheral annular recess 182 between the internal wall 70, the internal sidewall formed in the barrel terminal body 62 by the bore 68 and the outer periphery of the nib 180 itself. The recess 182 receives the angularly bent tabs 90 on the ends of the strips 86 of the barrel terminal body 80.

Figure 38:
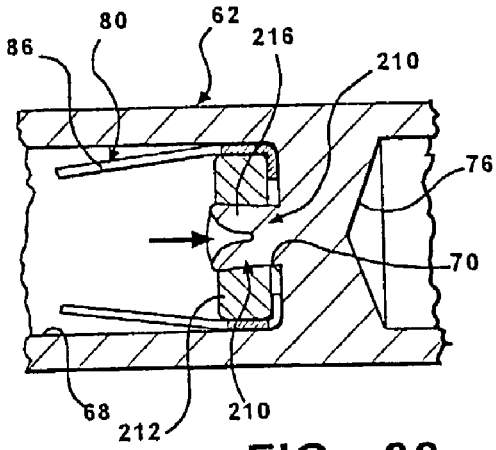

After the tabs 90 of the barrel terminal 80 have been inserted into the recess 182, force is applied in the direction of the arrow in FIG. 38 by a V-shaped punch, not shown, which forms a generally V-shaped depression 184 in the nib 180. This depression forces the malleable metal of the nib 180 radially and angularly outward against the tabs 90 and ends of the strips 86 of the barrel terminal 80 locking the internal end of the barrel terminal 80 to the barrel terminal body 62.

Figure 33:
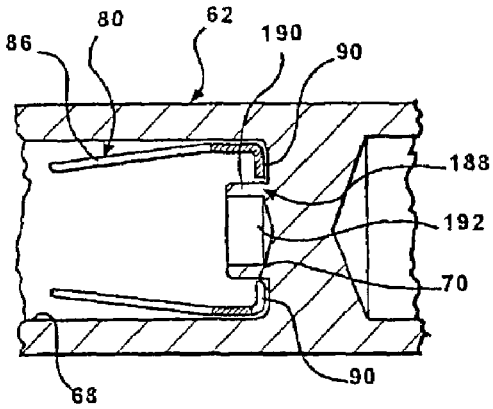
FIGS. 33 and 34 are partial, enlarged, longitudinal cross-sectional views showing another aspect of an internal anchor according to the present invention in a partially assembled and completely assembled state, respectively.
Figure 34:
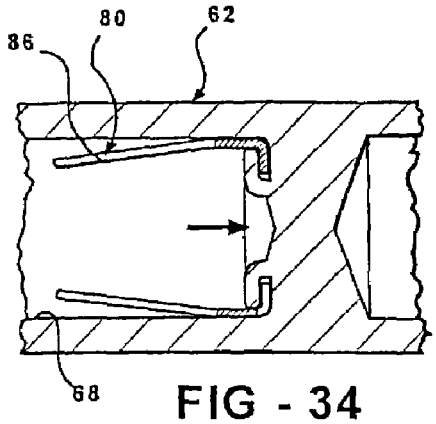

The internal grid anchor 188 shown in FIGS. 33 and 34 is similar to that described above and shown FIGS. 37 and 38 since the anchor 188 includes a generally cylindrical nib 190 projecting integrally the internal wall 70 in the bore 68 in the barrel terminal body 62. The nib 190 has a counter bore 192. Compressive force applied by an oversized diameter punch, not shown, in the counter bore 192 forces the metal of the nib 190 surrounding the counter bore 192 radially and axially outward mechanically locking the tabs 90 and/or ends of the strips 80 of the barrel terminal 80 against the inner surface of the barrel terminal body 62.

Figure 35:
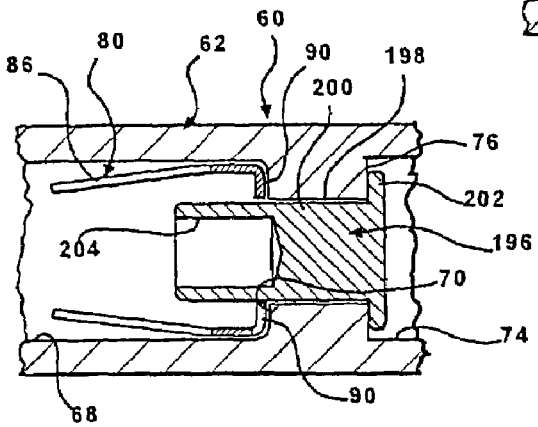
FIGS. 35 and 36 are partial, enlarged, longitudinal cross-sectional views showing another aspect of an internal anchor according to the present invention in a partially assembled and completely assembled state, respectively.
Figure 36:
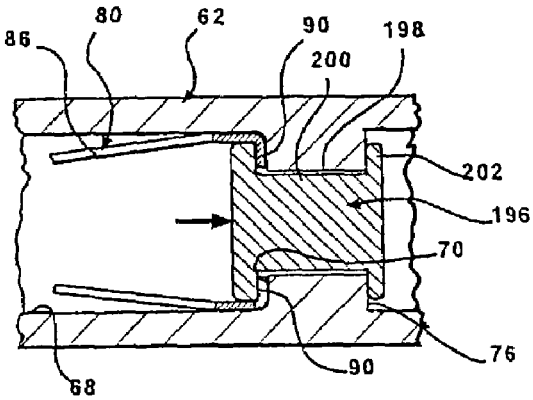

Another aspect of an internal grid anchor 196 is depicted in FIGS. 35 and 36. The anchor 196 is usable in connector applications where the material forming the barrel terminal body 62 is not malleable enough to enable deformation of the integrally formed nibs, such as nibs 168, 178 and 188.

In this application, a bore 198 is formed through the central solid portion of the terminal housing 60 between the internal wall 70 and the opposed internal wall 76. A cylindrical rivet-like body 200 has an enlarged end flange 202 at one end. The body 200 is inserted through the bore 198 with the enlarged end flange 202 disposed adjacent to the internal wall 76 in the bore 74 in the terminal housing 60. The other end of the body 200 has a counterbore 204 which extends axially away from the internal wall 70 beyond the tabs 90 on the ends of the strips 86 of the barrel terminal 80. A compressive force applied by a punch or die, not shown, in the direction of the arrow in FIG. 36 in the counterbore 204 deforms one end of the malleable body 200, while the other flange 202 end of the body 200 is held in a fixed position against the inner wall 76. This results in deformation of the end of the body 200 radially outward into a rivet-like mechanical interlock connection between the tabs 90 and the adjacent ends of the strips 86 of the barrel terminal 80 locking the barrel terminal 80 in contact with the inner wall of the barrel terminal body 62.

Figure 37:
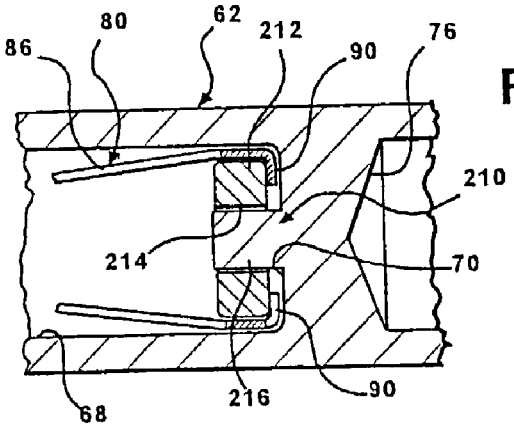
FIGS. 37 and 38 are partial, enlarged, longitudinal cross-sectional views showing another aspect of an internal anchor according to the present invention in a partially assembled and completely assembled state, respectively.

Yet another aspect of an internal grid anchor 210 is shown in FIGS. 37 and 38. The internal grid anchor 210 is a combination of the anchor 168 shown in FIGS. 35 and 36 and the anchor 178 shown in FIGS. 31 and 32. The internal grid anchor 210 includes a generally planar disc-shaped washer 212 having a central bore 214 which receives a cylindrical nib 216 formed as an integral extension of an interior solid portion of the barrel terminal body 62 which projects away from the internal wall 70 into the bore 68. After the barrel terminal 80 has been inserted into the bore 68, the washer 212 is inserted interiorly of the barrel terminal 80 adjacent to the angularly inward extending tabs 90 on the strips 86 of the barrel terminal 80. A compressive force in the direction of the arrow in FIG. 38 is applied by a V-shaped punch, not shown, which radially expands the malleable material of the nib 216 outward over one end surface of the washer 212 forcing the washer 212 into engagement with the projections 90 and locking the projections 90 and the adjacent end portions 86 of the barrel terminal 80 into engagement with the internal wall 70 and the inner surface of the bore 68 in the barrel terminal body 62.

Figure 39:
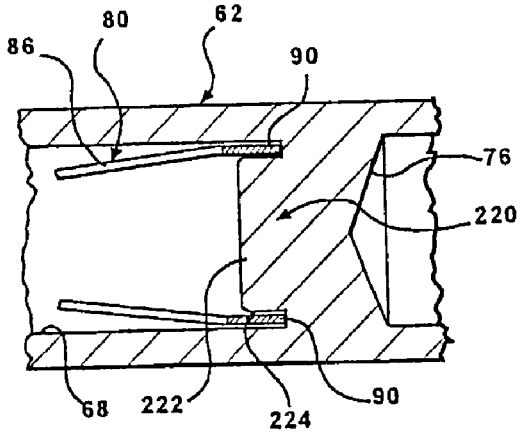
FIGS. 39 and 40 are partial, enlarged, longitudinal cross-sectional views showing another aspect of an internal anchor according to the present invention in a partially assembled and completely assembled state, respectively.
Figure 40:
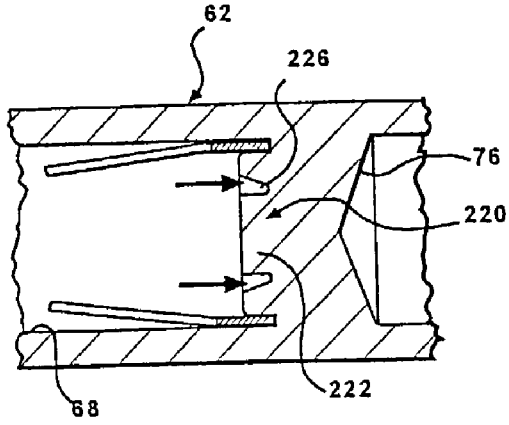

In the internal grid anchor 220 shown in FIGS. 39 and 40, an integral nib 222 projects from a central portion of the barrel terminal body 62 into the bore 68 and forms a deep, narrow annular recess 224 between the outer periphery of the nib 226 and the adjacent sidewall of the bore 68 in the barrel terminal body 62. The non-bent ends or tabs 90 of the barrel terminal body 80 are inserted into the recess 224. A circular V-shaped punch, not shown, is then linearly urged against the end surface of the nib 222 forming V-shaped notches 226 in the nib 222 and upsetting the material of the nib 222 radially outward closing the recess 224 and fixedly connecting the ends or tabs 90 of the strips 86 of the barrel terminal 80 with the adjacent sidewall of the barrel terminal body 62.

Figure 41:
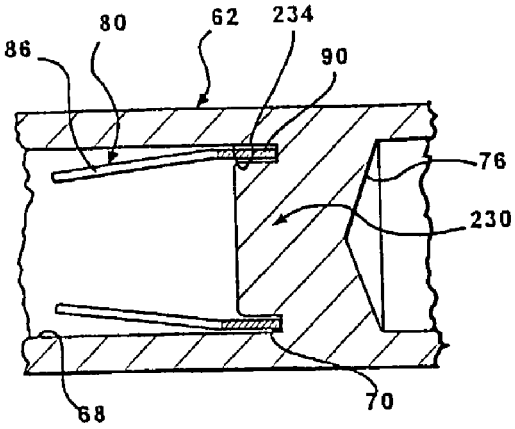
FIGS. 41 and 42 are partial, enlarged, longitudinal cross-sectional views showing another aspect of an internal anchor according to the present invention in a partially assembled and completely assembled state, respectively.
Figure 42:
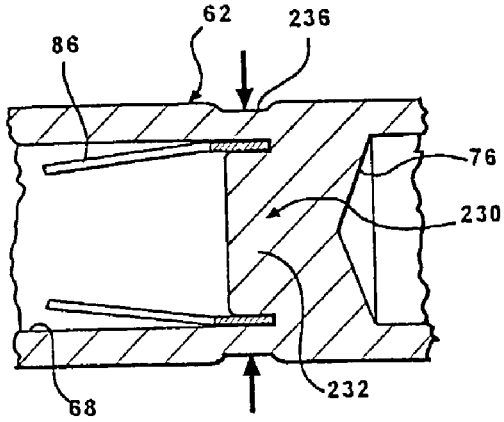

An internal grid anchor 230 shown in FIGS. 41 and 42 is a departure from the expandable nib anchors described above. The anchor 230 includes a cylindrical nib 232 projecting axially inward into the bore 68 from the internal wall 70. The outer peripheral surface of the nib 232 forms an annular recess 234 with the interior sidewall of the bore 68 in the barrel terminal body 62. The tabs 90 or ends of the strips 86 of the barrel terminal 80 are inserted into the recess 234 as shown in FIG. 41. Next, an external force in the direction of the arrows in FIG. 42 is applied to at least two diametrically opposed portions or, preferably, the entire circumference of the exterior surface of the barrel terminal body 80, preferably at the location of the internal wall 70 and the recess 234. This compressive force deforms the material forming the barrel terminal body 62 into depressions 236 shown in FIG. 42 and forcibly closes the recess 234 and locks the tabs 90 on the ends of the strips 86 of the barrel terminal 80 between the inner sidewall of the barrel terminal body 62 and the outer periphery of the nib 230.

Figure 43:
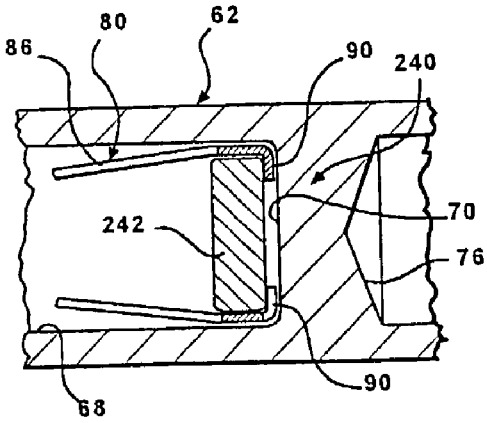
FIGS. 43 and 44 are partial, enlarged, longitudinal cross-sectional views showing another aspect of an internal anchor according to the present invention in a partially assembled and completely assembled state, respectively.
Figure 44:
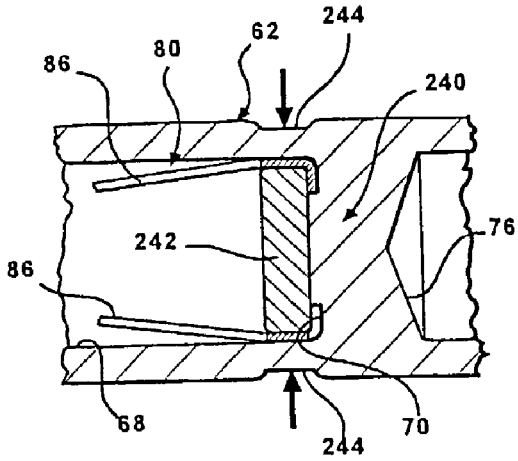
Figure 50:
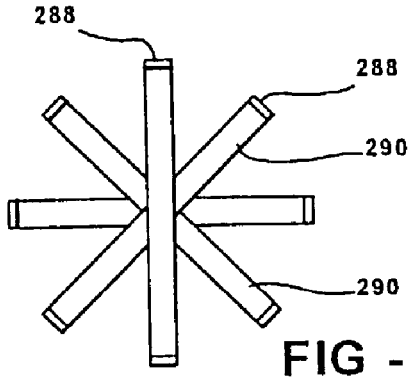
FIG. 50 is a cross-sectional view generally taken along line 50—50 in FIG. 51.

The internal grid anchor 240 shown in FIGS. 43 and 44, is similar to the anchor 230 and includes an annular, generally flat disc or washer 242 inserted into the bore 68 in the barrel terminal body 62. An external compressive, circumferential force shown by the arrows in FIG. 50 is applied to the exterior surface of the barrel terminal body 62 generally at the location of the washer 242. These forces result in a depression 244 which results in deformation of the metal forming the sidewall of the barrel terminal body 62 to mechanically interlock the tabs 90 and/or ends of the strips of the barrel terminal 80 with the washer 242 and the sidewall of the bore 68 of the barrel terminal body 62.

Figure 45:
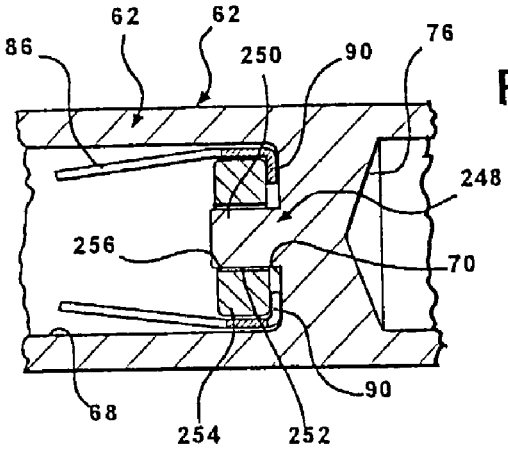
FIGS. 45 and 46 are partial, enlarged, longitudinal cross-sectional views showing another aspect of an internal anchor according to the present invention in a partially assembled and completely assembled state, respectively.
Figure 46:
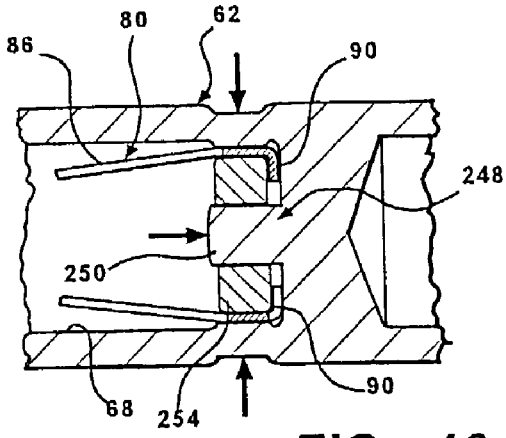

Another internal grid anchor 248 is shown in FIGS. 45 and 46. The anchor 248 is a combination of the anchor 240 and the anchor 168, both described above. The anchor 248 includes a nib 250 projecting axially into the bore 68 from the internal wall 70 in the barrel terminal body 62. The nib 250 may be formed by machining a recess in the blind end of the terminal housing 60, which recess is in the form of an annular recess 252 between the periphery of the nib 250 and the adjacent sidewall of the bore 68. A washer or planar disc 254 has a central bore 256 which is disposable about the periphery of the nib 250 when the washer 254 is disposed in the inner end of the bore 68 adjacent the internal wall 70. An external circumferential force in the direction of the arrows in FIG. 46 is applied to the exterior of the barrel terminal body 62 generally in line with the washer 254. The force may be applied by commercially available rotary swaging machines, eight-point indenter machines or other suitable swaging means. The compressive forces deform the sidewall of the barrel terminal body 62 to mechanically interlock the sidewall, the tabs 90 and the ends of the strips 86 of the barrel terminal 80, the washer 254 and the nib 250 into a secure, non-movable connection.

Linear force may optionally be applied to the exterior end of the nib 250 current with or after the circumferential force is applied to deform the end of the nib 250 around the adjacent end surface of the washer 254 in order to lock the washer 254 in the bore 68 with a high pull-out retention force.

Figure 47:
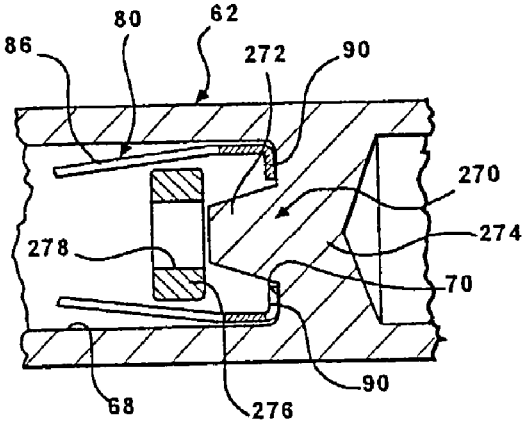
FIGS. 47 and 48 are partial, enlarged, longitudinal cross-sectional views showing another aspect of an internal anchor according to the present invention in a partially assembled and completely assembled state, respectively.
Figure 48:
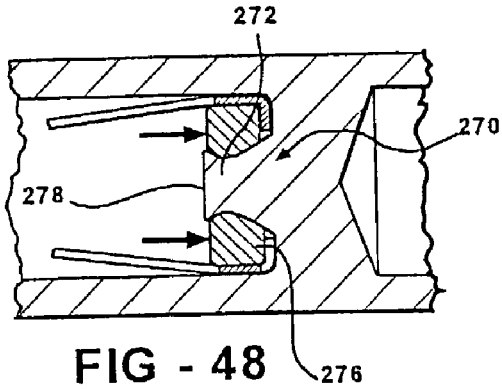

Another aspect of an internal grid anchor 270 shown in FIGS. 47 and 48 includes a cone-shaped nib 272 integrally extending from a central portion 274 of the barrel terminal body 62. The nib 272 has a conical exterior surface projecting away from the internal wall 70 into the bore 68. A generally annular washer or disc 276 having a central bore 278 is mountable over the nib 272.

In this aspect of the invention, the inner diameter of the bore 278 in the washer 276 is slightly larger than the smallest diameter of the nib 272, but smaller than the largest diameter of the nib 272. This allows the washer 276 to be inserted only a short distance over the nib 272. Linear force by means of a punch, not shown, in the direction of the arrows in FIG. 48 is applied to the annular surface of the washer 276 which deforms the washer 276 around the axially innermost, largest diameter portion of the nib 272. The conical nib 272 forces radially outward expansion of the washer 276 which in turn forces the grid members or strips 86 and the projections 90 at the end thereof against the inside surface of the bore 68 to lock the ends of the strips 86 in a fixed position. At the completion of the washer expansion, a second punch, not shown, expands or mushrooms the exposed end of the nib 272 over the washer 276 preventing the washer 276 from separating from the nib 272.

Figure 49:
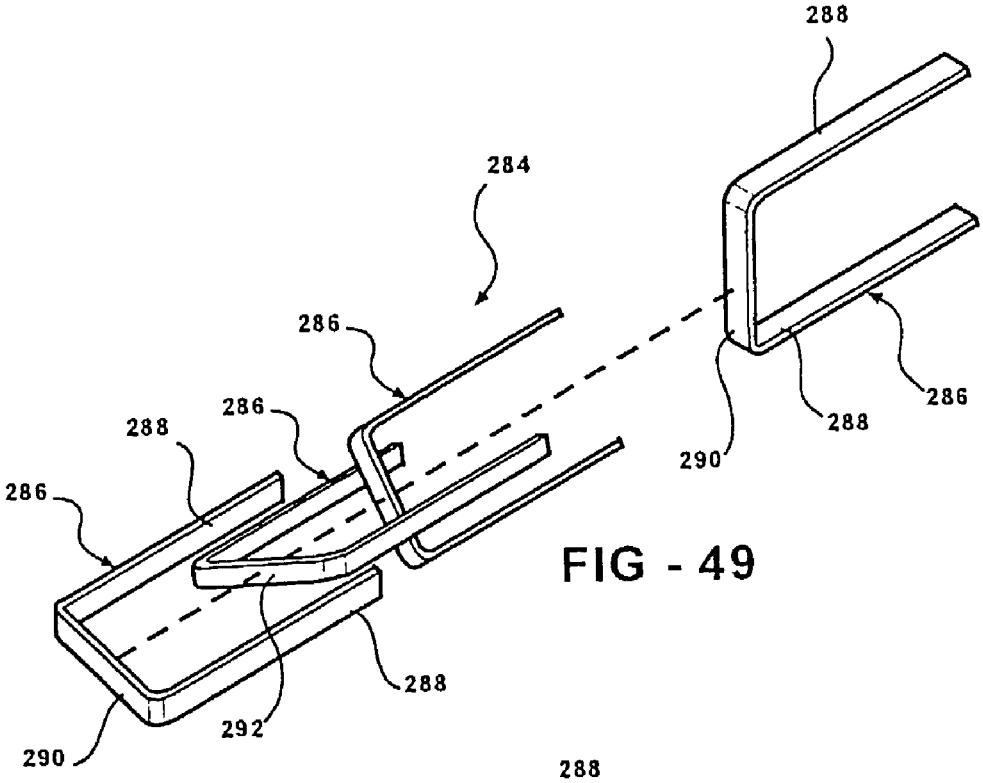
FIG. 49 is a partial, exploded, perspective view showing a preliminary assembly state of an internal anchor according to another aspect of the present invention.
Figure 51:
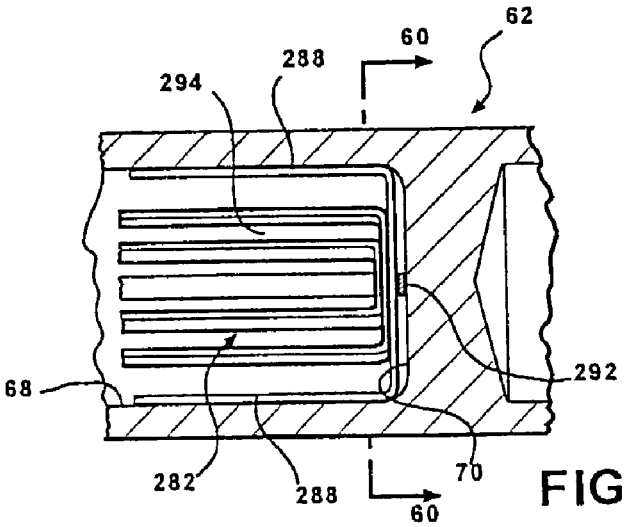
FIG. 51 is a partial, enlarged, longitudinal cross-sectional view showing the mounting of the internal anchor shown in FIGS. 49 and 50 in a terminal body.

Yet another aspect of internal anchor can be seen in FIGS. 49–51. Instead of a grid or a plurality of individual wires used to form the barrel terminal 80, the barrel terminal 284 is formed of a plurality of interlaced U-shaped wire contacts 286, formed of flat or round wires. Each contact 286, is formed of side legs 288 which are interconnected at one end by an end leg 290. As shown in FIG. 49, the end legs 290 of each of the plurality of contacts 286 are disposed one on top of the other and the side legs 288 angularly offset so as to space the side legs 288 on each contact 286 angularly apart from the side legs 288 of adjoining contacts 286.

The contacting portions of the end legs 290 are joined together, preferably by welding or low-temperature brazing/soldering as described above. The weld points 292 are preferably formed exteriorly of the barrel terminal housing 62 so as to enable the entire contact assembly to be inserted as a single unit into the bore 68.

As shown in FIG. 51, an expanding anchor nut 294, similar to the disc 152 or 162, described above, is then inserted into the interior of the contact assembly and subjected to a linear or axial force so as to expand the anchor nut 294 radially and axially outward so as to force and mechanically pinch at least the lower portions of the side legs 288 of each contact 286 and at least the outer most end leg 290 of the outer most contact 286 against the inner surfaces of the sidewall of the bore 68 and the interior wall 70 of the barrel terminal housing 62.

Figure 52:
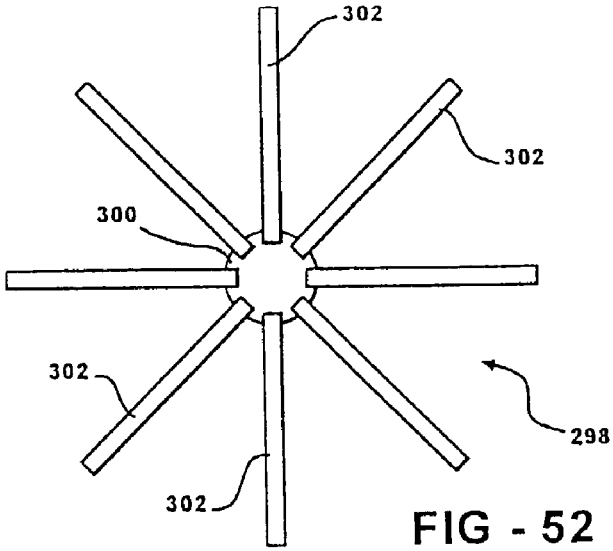
FIG. 52 is an end view of another aspect of an internal anchor according to the present invention.
Figure 53:
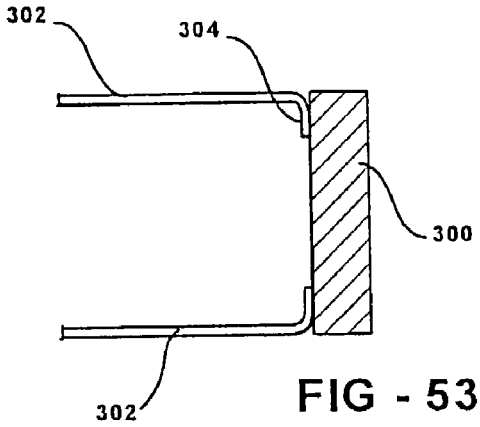
FIG. 53 is a longitudinal cross-sectional view of the internal grid anchor shown in FIG. 52.
Figure 54:
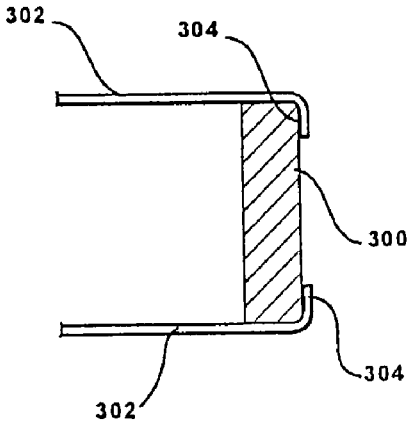
FIG. 54 is a longitudinal cross-sectional view, generally similar to FIG. 53, but showing another aspect of an internal anchor which is a modification of the internal anchor shown in FIGS. 52 and 53.

Yet another internal anchor 298 is shown in FIGS. 52–54. In this anchor 298, an expandable anchor nut 300, similar to expandable discs 152 and 162, has a plurality of elongated, discrete contacts or wire strips 302 secured to one surface by suitable joining processes, such as ultrasonic or capacitor discharge welding, or low-temperature brazing/soldering as described above. As shown in FIGS. 52 and 54, after the generally straight wires 302 are welded to the anchor nut 300 generally at an end 304, the wires 302 are bent around the peripheral surface of the anchor nut 300 and extend axially away from the anchor nut 300 to the entry end of the terminal housing 60. Alternately, the ends 304 of the contact wires 302 may be pre-formed into the angular or perpendicular configuration shown in FIG. 54 prior to attachment to the nut 300.

In an alternate construction, the contacts 302, shown in FIG. 53, are either pre-formed so that the ends 304 are at the illustrated angular position or bent after being welded at the ends 304 to the opposed surface of the anchor nut 300.

In either arrangement, the contact wires 302 may be cut to length without waste and then pre-formed or stamp shaped or provided in a linear configuration prior to adjoining to the anchor nut 300.

After welding and any necessary forming of the contact wires 302 to the shape shown in FIG. 53 or 54, the entire contact assembly is inserted into the bore 68 in the barrel terminal housing 62. The anchor nut 304 is then expanded, as described above, by the application of linear force to drive the ends 304 of the contact wires 302 in the aspect shown in FIG. 54 into secure contact with the surrounding walls of the bore 68 and the internal wall 70 of the barrel terminal housing 62.

In the aspect shown in FIG. 53, the expansion of the anchor nut 300 merely holds the contact assembly in place in the barrel terminal housing 62. Less contact is provided between the contact wires 302 and the surrounding wall of the bore 68 as compared to the arrangement shown in FIG. 54.

The entire contact assembly can be electro-plated as a unit or as individual elements depending upon the electroplating corrosion resistence requirements and/or the welding interface capability.

The various contact wires 302 to anchor nut 300 arrangements shown in FIGS. 53 and 54 will now be described in conjunction with a modified anchor nut using alternate joining processes for securing the anchor nut and the entire contact assembly to the barrel terminal body 62.

Figure 55:
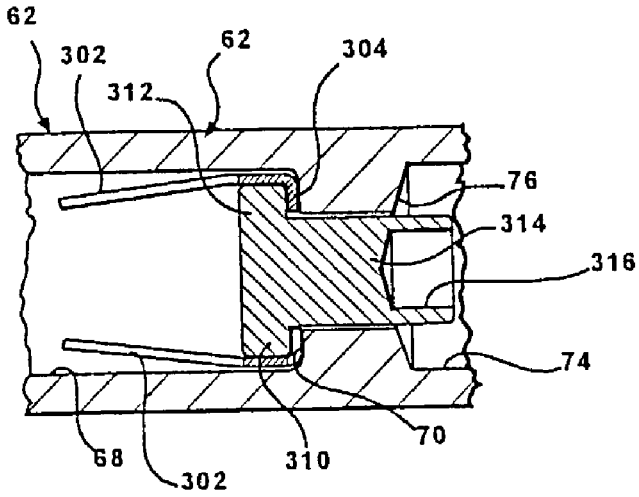
FIGS. 55 and 56 are partial, enlarged, longitudinal cross-sectional views showing another aspect of an internal anchor according to the present invention in a partially assembled and completely assembled state, respectively.
Figure 56:
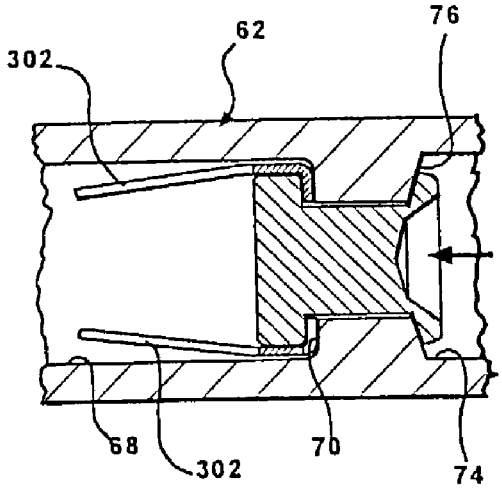

In FIGS. 55 and 56, an anchor nut 310 includes an annular disc-shaped end portion 312 from which a cylindrical shaft 314 extends. In this aspect of the invention, the contact wires 302 are welded or joined to what is referred to as an inner surface of the annular disc 312 as shown in FIG. 54. A recess 316 is formed at the opposite end of the shaft and receives a rivet punch, not shown, which expands the sidewalls surrounding the recess 316 radially outward into contact with the adjoining inner wall 76 in the bore 74 to draw the annular disc 312 and the ends 304 of the contact wires 302 to secure, mechanical fit and electrical contact with the inner surfaces of the bore 68 and the inner wall 70 of the barrel terminal body 62.

Figure 57:
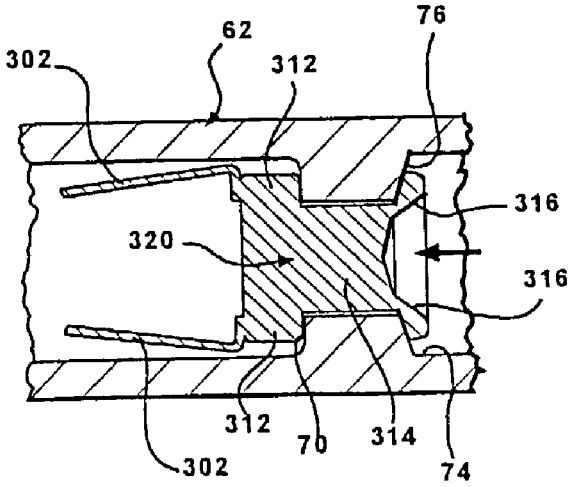
FIG. 57 is a partial, enlarged, longitudinal cross-sectional view showing another aspect of an internal anchor, with the initial, pre-assembly state of the internal anchor being similar to the internal anchor shown in FIG. 65.

In FIG. 57, the same rivet-type joining technique is employed to fixedly secure an anchor 320 to the inner wall 76 of the bore 74. However, in this aspect of the invention, the contact wires 302 are joined or welded to the opposite or outer surface of the annular disc 312 in the same manner as that described above and shown in FIG. 53. In this aspect, the contact members 302 are not wrapped around the periphery of the annular disc 312. Conductivity is less than with the anchor 310 shown in FIGS. 55 and 56.

Figure 58:
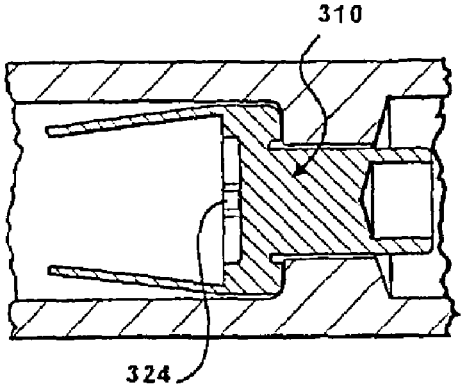
FIGS. 58 and 59 are partial, enlarged, longitudinal cross-sectional views showing another aspect of an internal anchor according to the present invention in a partially assembled and completely assembled state, respectively.
Figure 59:
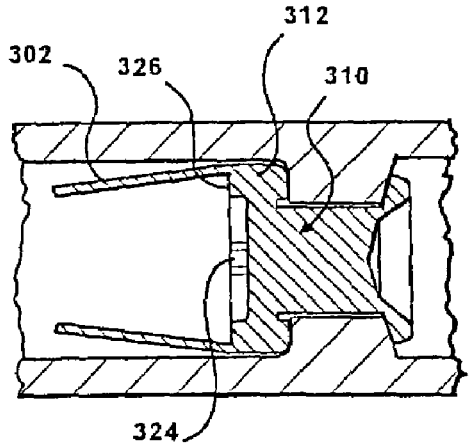

The anchor nut 310 shown in FIGS. 58 and 59 is identical to that described above and shown in FIGS. 55 and 56, except that a depression 324 is formed in the end surface 326 of the annular disc 312. The depression accommodates a fastener driving device, such as an Allen-head, Posidrive, square, etc., formed in the end of the anchor nut 310 prior to welding. Later, when the contact assembly has been placed into the bore 68 of the terminal body 60, the appropriate fastener driving device is used to twist the hyperbolic form into the contact wires 302. While the contact wires 302 and the annular disc 312 remain in the twisted or angularly rotated position, the opposed rivet end of the anchor nut 310 is expanded, as described above, anchoring the formed hyperbolic twist in place.

Figure 60:
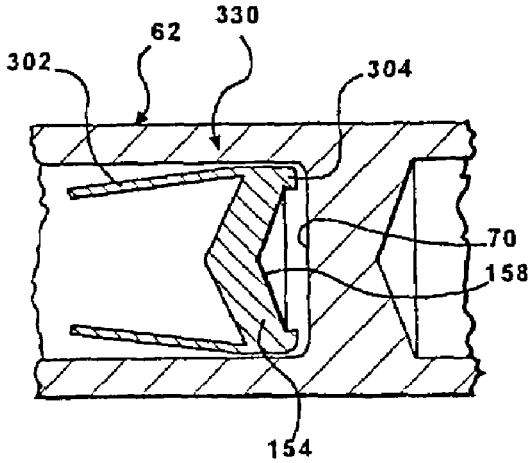
FIGS. 60 and 61 are partial, enlarged, longitudinal cross-sectional views showing another aspect of an internal anchor according to the present invention in a partially assembled and completely assembled state, respectively.
Figure 61:
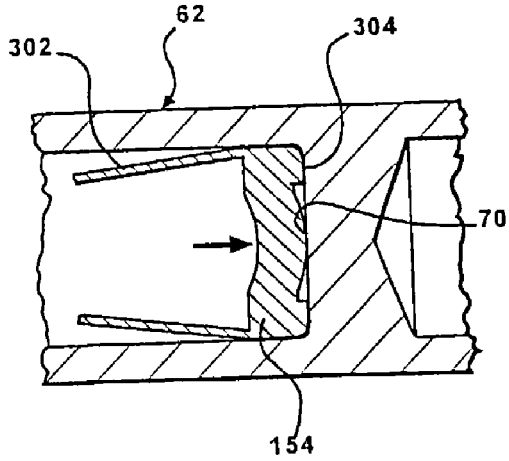

In FIGS. 60 and 61, the anchor is in the form of a conical disc 154 identical to that described above and shown in FIGS. 25 and 26. However, in this aspect of the internal anchor, the individual contact strips or wires 302 are joined, such as by welding, at angularly disposed ends 304 to the second surface 158 of the conical disc 154.

As shown in FIG. 61, the disc 154 is then expanded, as described above, to sandwich the ends 304 of the contact wires 302 firmly between the inside of the barrel terminal body bore 68, the anchor disc 154 and the internal wall 70.

Figure 62:
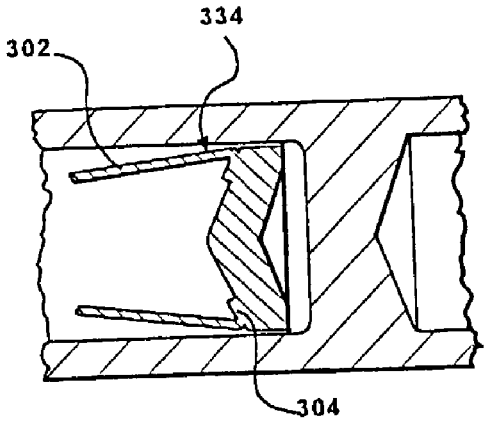
FIGS. 62 and 63 are partial, enlarged, longitudinal cross-sectional views showing another aspect of an internal anchor according to the present invention in a partially assembled and completely assembled state, respectively.
Figure 63:
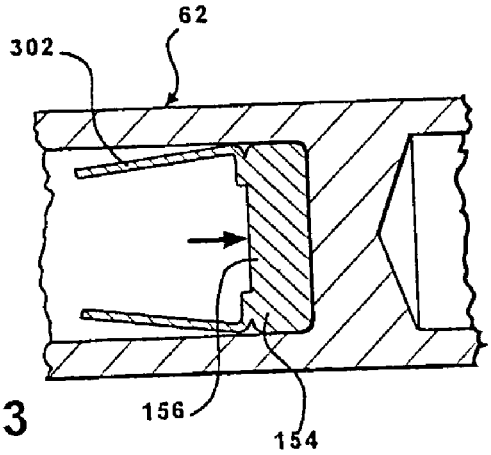

The anchor 334 shown in FIGS. 62 and 63 is similar to the anchor 330 except that the ends 304 of the contact wires 302 are joined or welded to the opposite surface 156 of the anchor disc or nut 154. As a result, the current path is between the contact members 302 and the nut 300 to the barrel terminal body 62 such that electrical conductivity and mechanical strength is less than the internal anchor shown in FIGS. 61 and 62.

Figure 64:
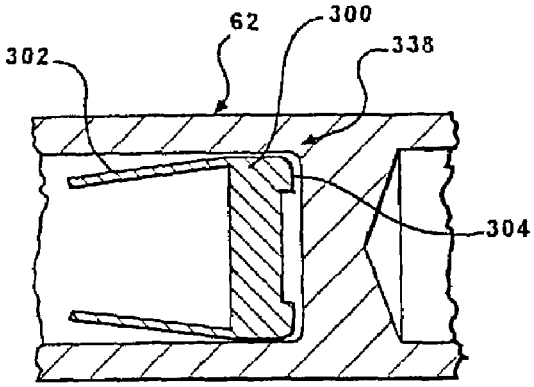
FIGS. 64 and 65 are partial, enlarged, longitudinal cross-sectional views showing another aspect of an internal anchor according to the present invention in a partially assembled and completely assembled state, respectively.
Figure 65:
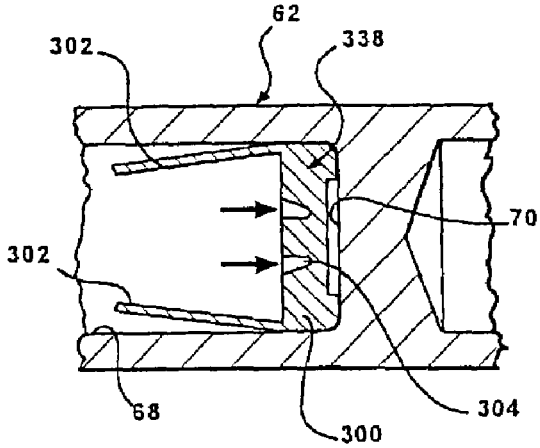

In the aspect of the internal anchor shown in FIGS. 64 and 65, the anchor nut 300 is similar to the annular disc 162 described above and shown in FIGS. 22 and 28. The ends 304 of the contact wires 302 are wrapped around and joined, such as by welding, to a surface of the anchor nut 300 facing the internal wall 70. Expansion of the anchor nut 300 by means of a V-shaped punch which creates the V-shaped recesses in the anchor nut, as described above, forces the material of the anchor nut 300 radially and axially outward tightly compressing the anchor nut 300 to the interior walls of the bore 68 and the internal wall 70 of the barrel terminal body 62.

Figure 66:
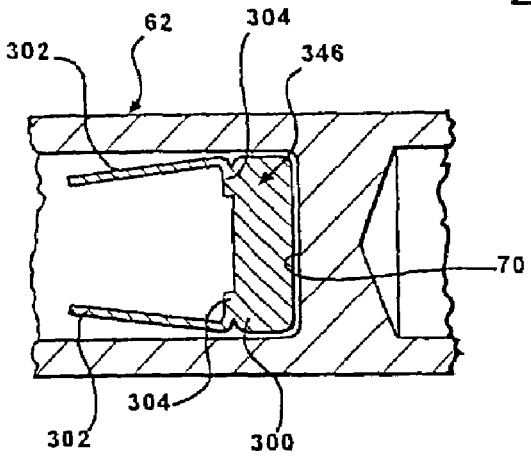
FIGS. 66 and 67 are partial, enlarged, longitudinal cross-sectional views showing another aspect of an internal anchor according to the present invention in a partially assembled and completely assembled state, respectively.
Figure 67:
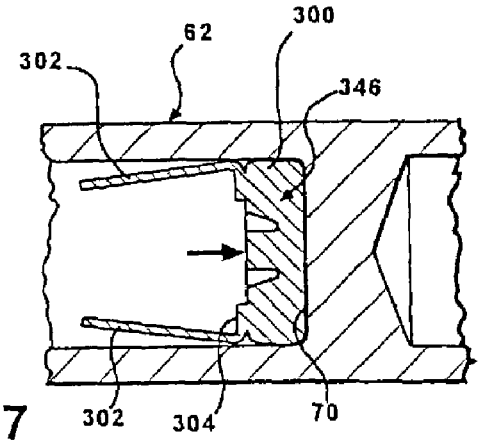

The anchor 346 shown in FIGS. 66 and 67 is similar to the anchor 338 shown in FIGS. 64 and 65 except that the ends 304 of the contact wires 302 are joined, such as by welding, to the opposite surface of the anchor nut 300 away from the internal wall 70 in the barrel terminal body 62.

Figure 68:
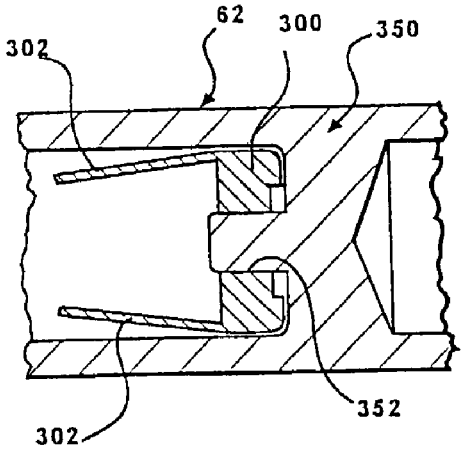
FIGS. 68 and 69 are partial, enlarged, longitudinal cross-sectional views showing another aspect of an internal anchor according to the present invention in a partially assembled and completely assembled state, respectively.
Figure 69:
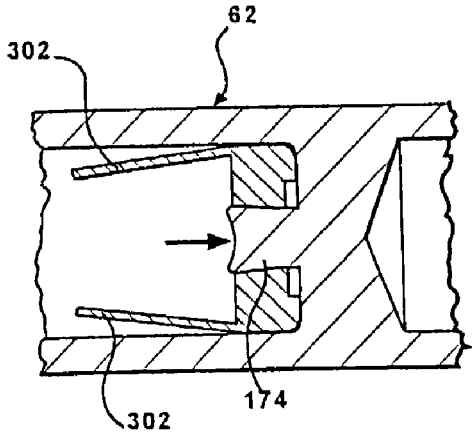

FIGS. 68 and 69 depict yet another anchor 350 which has the anchor nut 300 similar to the annular washer 170 in the anchor shown in FIGS. 29 and 30. The bore 352 in the anchor nut 300 is disposable about the nib 174 and fixed in place by expansion of the nib 174 as described above in conjunction with the anchor illustrated in FIGS. 29 and 30. The contact wires 302 wrap around the nut 300 and are joined to the nut 300 on the surface of the nut facing the wall 70.

Figure 70:
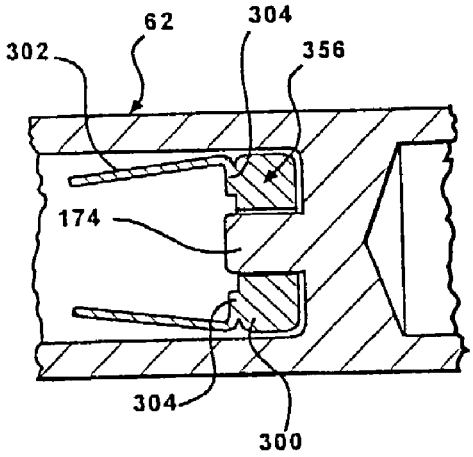
FIGS. 70 and 71 are partial, enlarged, longitudinal cross-sectional views showing another aspect of an internal anchor according to the present invention in a partially assembled and completely assembled state, respectively.
Figure 71:
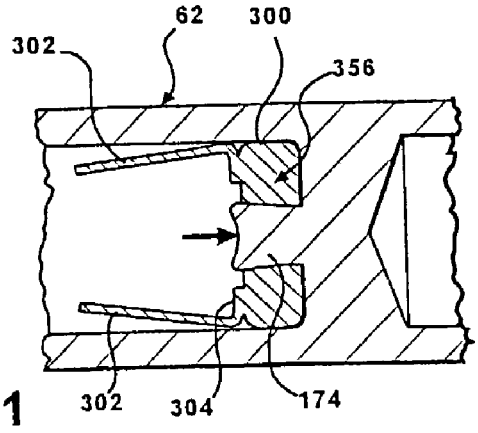
Figure 72:
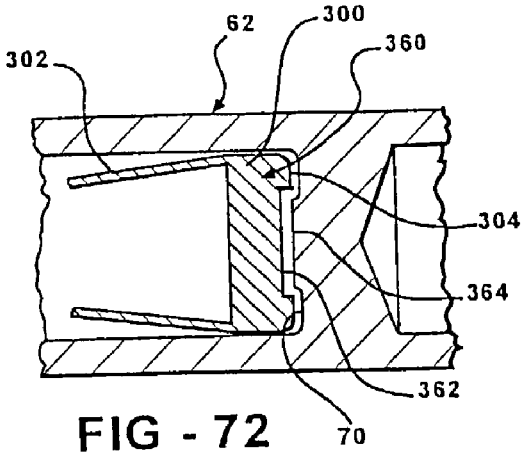
FIGS. 72 and 73 are partial, enlarged, longitudinal cross-sectional views showing another aspect of an internal anchor according to the present invention in a partially assembled and completely assembled state, respectively.

The anchor 356 shown in FIGS. 70 and 71 is similar to the anchor 352 except that the ends 304 of the contact wires 302 are joined, such as by welding, to the opposite surface of the anchor nut 300.

FIGS. 72 and 73, and 74 and 75 depict substantially identical anchors 360 and 366, respectively. Each anchor 360 and 362 includes the anchor disc or nut 300. In the anchor 360, the ends 304 of the contact wires 302 are joined, such as by welding, to the surface 362 of the anchor nut 300. In the anchor 366, shown in FIGS. 74 and 75, the ends 304 of the contact wires 302 are joined, such as by welding, to the opposite surface 368 of the anchor nut 300.

Figure 73:
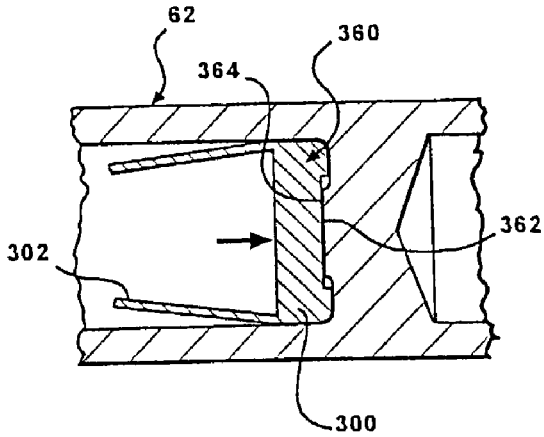

In the anchor 360, a raised projections 364 extends from a central portion of the internal wall 70 in the barrel terminal body 62. The projection 364 seats between the radially inner ends 304 of the contact wires 302 and provides a location for joining, such as by welding as described above, to the surface 362 of the anchor nut 300 as shown in FIG. 73.

Figure 74:
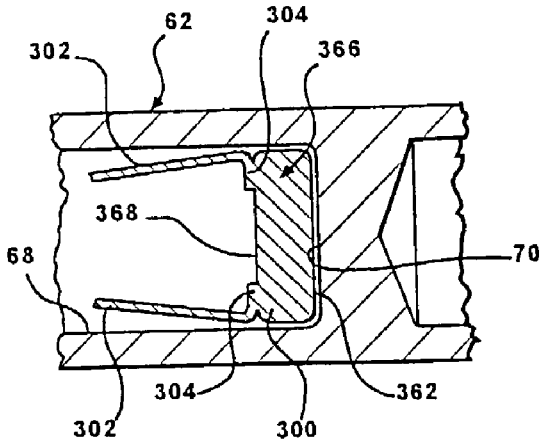
FIGS. 74 and 75 are partial, enlarged, longitudinal cross-sectional views showing another aspect of an internal anchor according to the present invention in a partially assembled and completely assembled state, respectively.
Figure 75:
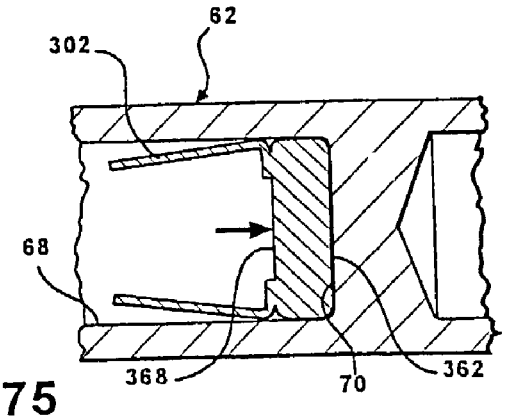
Figure 85:
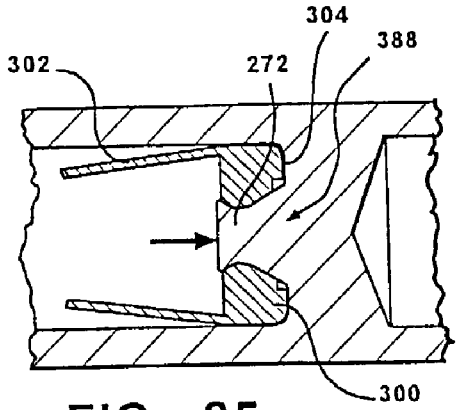

The anchor nut 300 in the anchor 366 shown in FIGS. 74 and 75 has a flat surface 362 since the ends 304 of the contact wires 302 are joined to the opposite surface 368 of the anchor nut 300. The surface 362 is welded or otherwise fixedly joined to the internal wall 70 at the end of the bore 68 in the barrel terminal body 62 as shown in FIG. 85.

Figure 76:
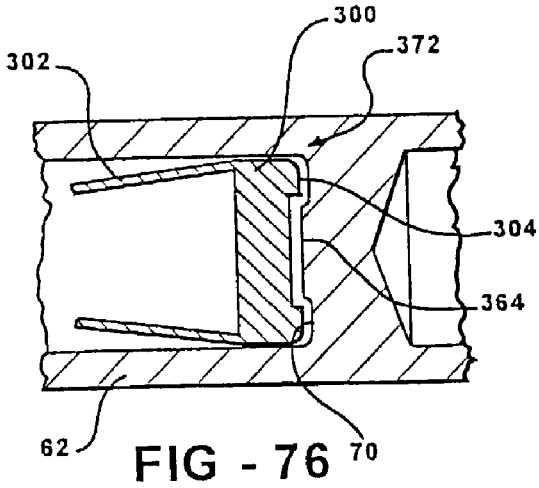
FIGS. 76 and 77 are partial, enlarged, longitudinal cross-sectional views showing another aspect of an internal anchor according to the present invention in a partially assembled and completely assembled state, respectively.
Figure 77:
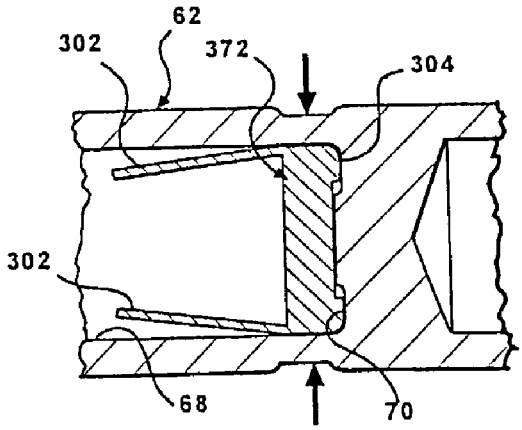

The anchor 372 shown in FIGS. 76 and 77 is identical to the anchor 360 as the projection 364 extends from the inner internal wall 70 as in the anchor 360. However, as shown in FIG. 77, instead of welding the anchor nut 300 to the internal wall 70 of the barrel terminal body 62, a circumferential force is applied to the exterior sidewall of the barrel terminal body 62 to compress the sidewall in area of the internal end of the bore 68 causing the metal of the sidewall to expand and securely connect the ends 304 of the contact wires 302 with the surrounding inner surfaces of the sidewalls of the bore 68 and the internal wall 70 of the barrel terminal body 62.

Figure 78:
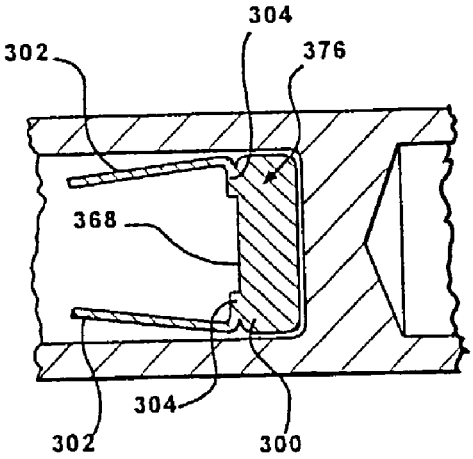
FIGS. 78 and 79 are partial, enlarged, longitudinal cross-sectional views showing another aspect of an internal anchor according to the present invention in a partially assembled and completely assembled state, respectively.
Figure 79:
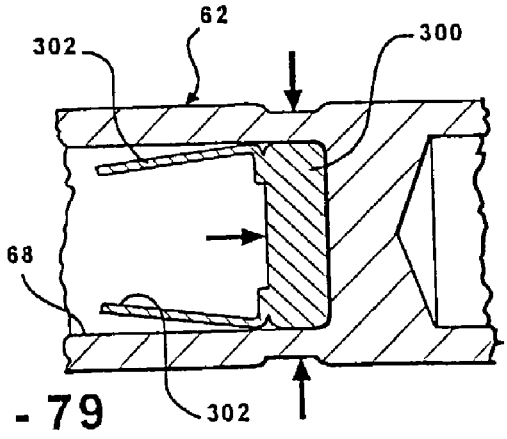

The anchor 376 as shown in FIGS. 78 and 79 is identical to the anchor 366 shown in FIGS. 74 and 75 except that the ends 304 of the contact wires 302 are joined, such as by welding, to the opposite surface 368 of the anchor nut 300. A circumferential force is applied to the sidewall of the barrel terminal body 62, generally in line with the anchor nut 300 as shown in FIG. 79, to deform the sidewall of the barrel terminal body 62 into secure contact with the contact wires 302 and the anchor nut 300 to retain the anchor nut 300 and the contact wires 302 in the bore 68 of the barrel terminal body 62.

Figure 80:
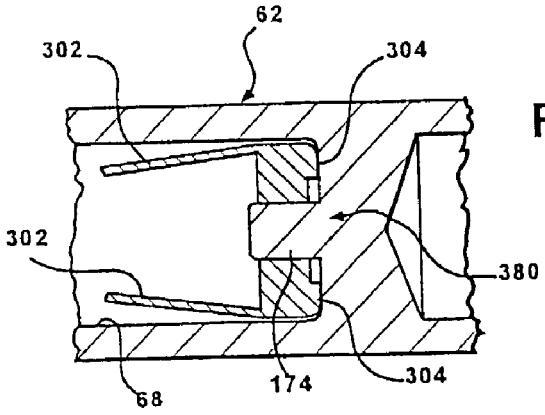
FIGS. 80 and 81 are partial, enlarged, longitudinal cross-sectional views showing another aspect of an internal anchor according to the present invention in a partially assembled and completely assembled state, respectively.
Figure 81:
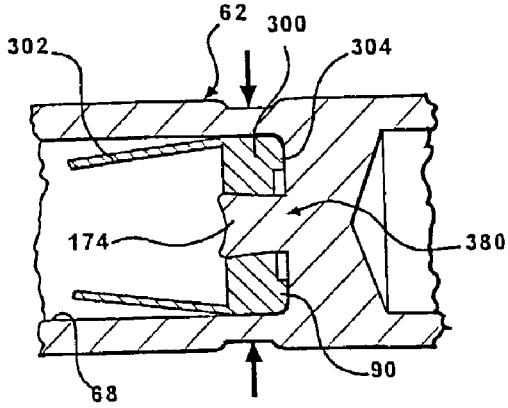

The anchor 380 shown in FIGS. 80 and 81 is identical to the anchor 350 in that the ends 304 of the contact wires 302 are wrapped around the side edge and joined or welded to one end surface of the anchor nut 300. A bore in the anchor nut 300 receives the projection or nib 174 therethrough. The nib 174 projects axially from the internal wall 70 into the bore 68 of the barrel terminal body 62.

Deformation of the nib 174, as previously above, expands the anchor nut 300 radially and axially outward forcibly driving the ends 304 of the contact wires 302 in a secure mechanical and electrical connection with the surrounding walls of the bore 68 of the barrel terminal body 62. Circumferential force is applied to the barrel terminal body 62 to compress and mechanically join the anchor nut 300, the ends 304 of the contact wires 302 and the nib 174. The outward mushrooming of the outer end of the nib 174 also mechanically locks the anchor nut 300 in the bore 68.

Figure 82:
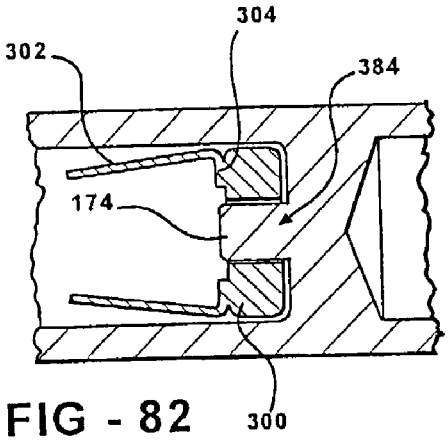
FIGS. 82 and 83 are partial, enlarged, longitudinal cross-sectional views showing another aspect of an internal anchor according to the present invention in a partially assembled and completely assembled state, respectively.
Figure 83:
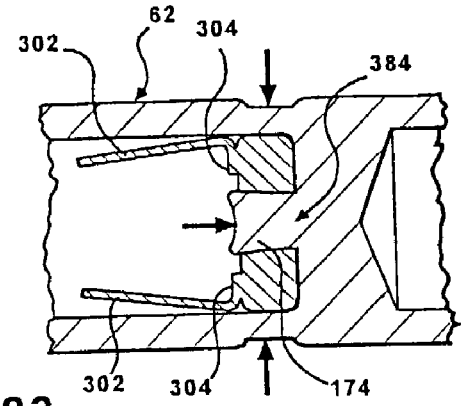

The anchor 384 shown in FIGS. 82 and 83 is formed in a similar manner as the anchor 380 by use of the circumferential deforming force, except that the ends 304 of the contact wires 302 are joined to the opposite surface of the anchor nut 300.

Figure 84:
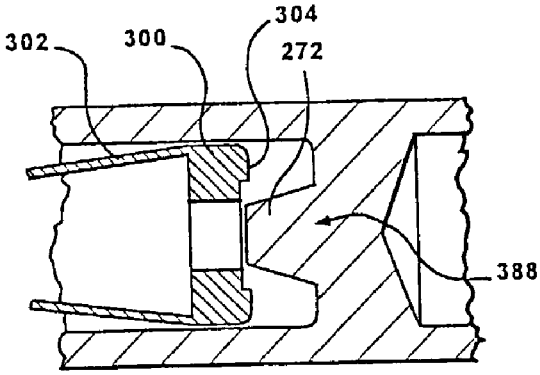
FIGS. 84 and 85 are partial, enlarged, longitudinal cross-sectional views showing another aspect of an internal anchor according to the present invention in a partially assembled and completely assembled state, respectively.
Figure 86:
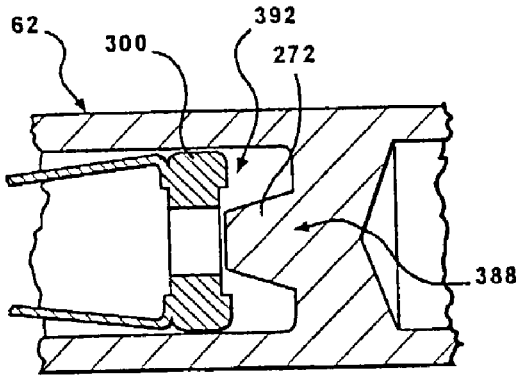
FIGS. 86 and 87 are partial, enlarged, longitudinal cross-sectional views showing another aspect of an internal anchor according to the present invention in a partially assembled and completely assembled state, respectively.
Figure 87:
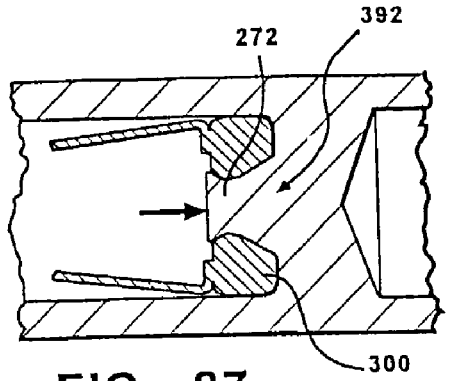

The anchor 388 shown in FIGS. 84 and 85 and the anchor 392 shown in FIGS. 86 and 87 are identical to the anchor nuts 300 and contacts 302 shown in FIGS. 80 and 82 respectively. The nib 272 is identical to that described above for the anchor 270 shown in FIGS. 47 and 48 in that the nib 272 has a conical shape with the internal bore in the anchor nut 300 having an inner diameter larger than the smallest outer diameter of the nib 372, but smaller than the largest outer diameter of the nib 372. Compressive axial force on the anchor nut 300, as shown in FIGS. 85 and 87, will drive the anchor nut 300 as well as the ends 304 of the contacts 302 in the case of the anchor 388 shown in FIG. 85 or only the anchor nut 300 itself in the case of the anchor 392 shown in FIG. 87 into secure mechanical contact with the surrounding walls of the bore 68 in the barrel terminal body 62.

Figure 88:
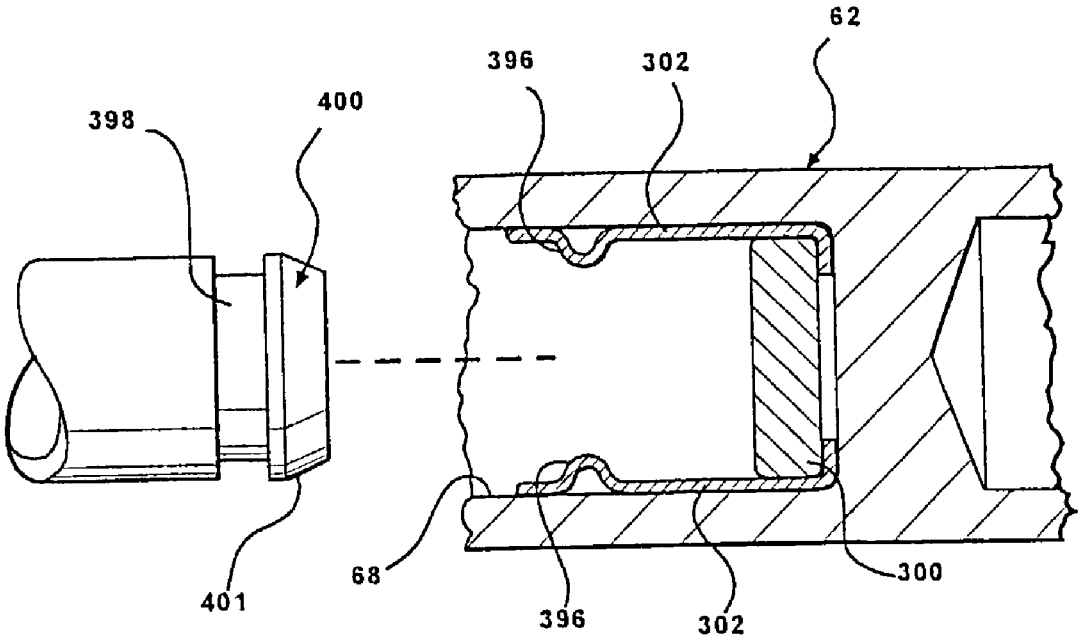
FIG. 88 is an partial, enlarged, longitudinal cross-sectional view of a grid for a barrel terminal according to another aspect of the present invention having an internal detent for engagement with an insertable pin.
Figure 89:
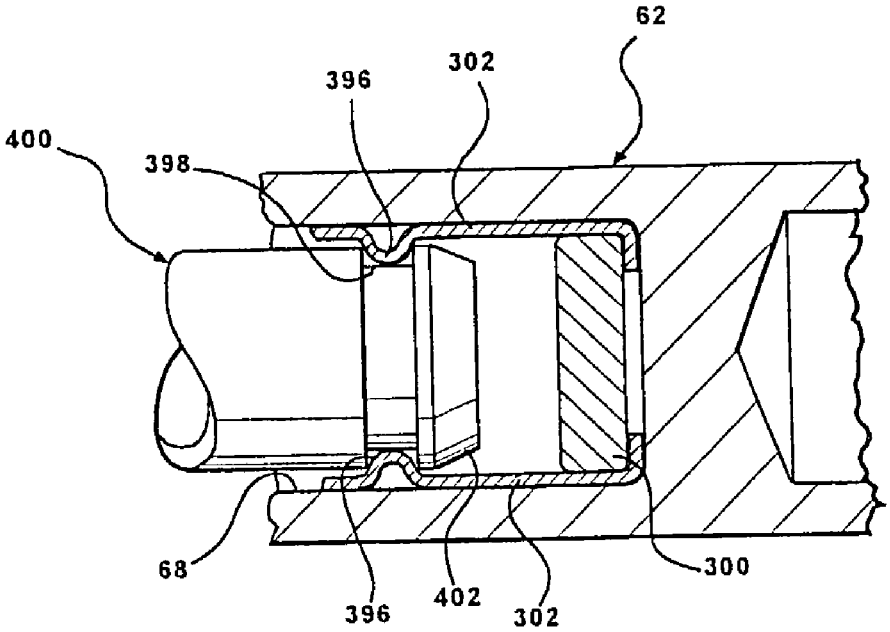
FIG. 89 is a partial, longitudinal cross-sectional view showing the fully inserted position of the pin relative to the grid detent shown in FIG. 88.

FIGS. 88 and 89 depict a modification to the contact wires 302 to include a detent 396 at a position to engage a mating recess 398 in a connector pin 400 adapted to be slidably inserted into the bore 68 in the barrel terminal body 62 in engagement with the contacts 302. The detent 396 is formed at a position spaced from the anchor nut 300. It will be understood that the anchor nut 300 as well as the contacts 302 are anchored at an internal end to the barrel terminal body by any of the above-described internal anchor techniques and processes.

The detent 396 may take any suitable shape, such as the smooth arcuate shape shown FIG. 88 or a more angled ramp-like shape. The angle and height of the detent 396 as well as the angle of the mating insertion end 402 of the pin 400 will determine the insertion and extraction retention forces provided for the connector.

The above-described external end grid anchor techniques and the internal end grid anchor techniques can generally be employed with each other in practically any combination depending upon the particular application requirements, overall size of the terminal, etc.

What is claimed is:

1. An electrical connector for connecting first and second conductive elements, the electrical connector comprising:

a housing having a first bore extending from a first end of the housing to a second end, and a second bore of smaller diameter than the first bore of the housing;

a contact formed of a plurality of elongated contact strips mounted in the bore in the housing through the first end, the contact having first and second ends wherein the first and second ends are angularly offset to form each contact strip in a hyperbolic shape between the first and second ends of the contact;

external end anchor means for fixedly connecting the first end of the contact to the first end of the housing; and internal anchor means for fixedly connecting the second end of the contact internally within the bore of the housing, the internal anchor means comprises a member disposed through the second bore of the housing, the member having a portion extending into the first bore in the housing.

2. The electrical connector of claim 1, wherein:

the second ends of the contact strips fixed to the member prior to insertion of the member into the first bore in the housing.

3. The electrical connector of claim 1, wherein:

the member being distinct from the housing; and the member being expandable to forcibly engage the member, the second ends of the contact strips and the housing in a fixed electrical connection.

4. The electrical connector of claim 1, wherein:

the member being distinct from the housing, and disposed adjacent the second ends of the contact strips; and the housing being deformable to fixedly engage the housing, the second ends of the contact strips and the member in a fixed electrical connection.

5. The electrical connector of claim 1, wherein:

the member disposed adjacent to the second ends of the contact strips in the first bore in the housing.

6. The electrical connector of claim 1, wherein:

the second ends of the contact strips fixed to the member prior to insertion of the member into the first bore in the housing.

7. The electrical connector of claim 38 wherein: the member of the internal anchor means is an integral part of the housing.

8. The electrical connector of claim 1 further comprising:

the housing formed with a reduced diameter portion extending from the first end of the first bore to a larger second diameter portion intermediate the first and second ends of the first bore;

the first ends of the contact strips bent over the reduced diameter portion of the housing; and an annular collar mounted over the bent first ends of the contact strips to stationarily fix the first ends of the contact strips to the reduced diameter portion of the housing.

9. The electrical connector of claim 1 further comprising:

the housing formed with a substantially constant diameter between the first and second ends of the first bore;

the first ends of the contact strips bent over the first end of the housing; and a collar fixed over the first ends of the contact strips to fix the first ends of the contact strips to the housing.

10. The electrical connector of claim 1 further comprising:

the contact strips formed as U-shaped separate members, each with an end leg joined between one end of two spaced side legs;

the end legs of each of a plurality of contact strips overlaid and the contact strips angularly offset to circumferentially space the side legs of adjacent contact strips; and the end legs of the contact strips fixed together.

11. The electrical connector of claim 10 further comprising: the overlaid end legs of the contact strips welded together.

12. The electrical connector of claim 1 further comprising:

the contact strips formed as individual members having opposed first and second ends; and one end of the contact strips fixed to the member in a circumferentially spaced orientation.

13. An electrical connector for connecting first and second conductive elements, the electrical connector comprising:

a housing having a bore extending from a first end of the housing to a second end;

a contact formed of a plurality of elongated contact strips mounted in the bore in the housing through the first end, the contact having first and second ends wherein the first and second ends are angularly offset to form each contact strip in a hyperbolic shape between the first and second ends of the contact;

external end anchor means for fixedly connecting the first end of the contact to the first end of the housing; and internal anchor means for fixedly connecting the second end of the contact internally within the bore of the housing, the internal anchor means comprises a member having an aperture; a projection carried on the housing and extending from the second end of the bore in the housing; and the member being engaged with the projection through the aperture, the member forcibly expandable into fixed electrical connection with the second ends of the contact strips and the housing.

14. The electrical connector of claim 13 wherein:

the projection having sidewalls tapering radially outward from a first end remote from the second end of the bore to the second end of the bore; and the member being radially expandable when forcibly inserted over the projection.

15. The electrical connector of claim 13 wherein:

the member of the internal anchor means is an integral part of the housing, the member having a portion extending from the second end of the bore.

16. The electrical connector of claim 13 further comprising:

the housing formed with a reduced diameter portion extending from the first end of the bore to a larger second diameter portion intermediate the first and second ends of the bore;

the first ends of the contact strips bent over the reduced diameter portion of the housing; and an annular collar mounted over the bent first ends of the contact strips to stationarily fix the first ends of the contact strips to the reduced diameter portion of the housing.

17. The electrical connector of claim 13 further comprising:

the housing formed with a substantially constant diameter between the first and second ends of the bore;

the first ends of the contact strips bent over the first end of the housing; and a collar fixed over the first ends of the contact strips to fix the first ends of the contact strips to the housing.

18. The electrical connector of claim 13 further comprising:

the contact strips formed as U-shaped separate members, each with an end leg joined between one end of two spaced side legs;

the end legs of each of a plurality of contact strips overlaid and the contact strips angularly offset to circumferentially space the side legs of adjacent contact strips; and the end legs of the contact strips fixed together.

19. The electrical connector of claim 18 further comprising:

the overlaid end legs of the contact strips welded together.

20. The electrical connector of claim 13 further comprising:

the contact strips formed as individual members having opposed first and second ends; and one end of the contact strips fixed to the member in a circumferentially spaced orientation.

21. An electrical connector for connecting first and second conductive elements, the electrical connector comprising:

a housing having a bore extending from a first end of the housing to a second end;

a contact formed of a plurality of elongated contact strips mounted in the bore in the housing through the first end, the contact having first and second ends wherein the first and second ends are angularly offset to form each contact strip in a hyperbolic shape between the first and second ends of the contact;

external end anchor means for fixedly connecting the first end of the contact to the first end of the housing; and internal anchor means for fixedly connecting the second end of the contact internally within the bore of the housing, the internal anchor means comprises a member having an aperture; a projection carried on the housing and extending from the second end of the bore in the housing; and the member being engaged with the projection through the aperture, the housing forcibly deformable to fix the member, the contact strips and the housing in electrical connection.

22. The electrical connector of claim 21 wherein:

the projection having sidewalls tapering radially outward from a first end remote from the second end of the bore to the second end of the bore; and the member being radially expandable when forcibly inserted over the projection.

23. The electrical connector of claim 21 wherein:

the member of the internal anchor means is an integral part of the housing, the member having a portion extending from the second end of the bore.

24. The electrical connector of claim 21 further comprising:

the housing formed with a reduced diameter portion extending from the first end of the bore to a larger second diameter portion intermediate the first and second ends of the bore;

the first ends of the contact strips bent over the reduced diameter portion of the housing; and an annular collar mounted over the bent first ends of the contact strips to stationarily fix the first ends of the contact strips to the reduced diameter portion of the housing.

25. The electrical connector of claim 21 further comprising:

the housing formed with a substantially constant diameter between the first and second ends of the bore;

the first ends of the contact strips bent over the first end of the housing; and a collar fixed over the first ends of the contact strips to fix the first ends of the contact strips to the housing.

26. The electrical connector of claim 21 further comprising:

the contact strips formed as U-shaped separate members, each with an end leg joined between one end of two spaced side legs;

the end legs of each of a plurality of contact strips overlaid and the contact strips angularly offset to circumferentially space the side legs of adjacent contact strips; and the end legs of the contact strips fixed together.

27. The electrical connector of claim 26 further comprising:

the overlaid end legs of the contact strips welded together.

28. The electrical connector of claim 21 further comprising:

the contact strips formed as individual members having opposed first and second ends; and one end of the contact strips fixed to the member in a circumferentially spaced orientation.

29. An electrical connector for connecting first and second conductive elements, the electrical connector comprising:

a housing having a bore extending from a first end of the housing to a second end, and a projection extending from the second end of the bore into the bore in the housing;

a contact formed of a plurality of elongated contact strips mounted in the bore in the housing through the first end, the contact having first and second ends wherein the first and second ends are angularly offset to form each contact strip in a hyperbolic shape between the first and second ends of the contact;

external end anchor means for fixedly connecting the first end of the contact to the first end of the housing; and internal anchor means for fixedly connecting the second end of the contact internally within the bore of the housing, and the internal anchor means comprises a member fixedly welded to the projection.

30. The electrical connector of claim 29 wherein:

the member of the internal anchor means is an integral part of the housing, the member having a portion extending from the second end of the bore.

31. The electrical connector of claim 29 further comprising:

the housing formed with a reduced diameter portion extending from the first end of the bore to a larger second diameter portion intermediate the first and second ends of the bore;

the first ends of the contact strips bent over the reduced diameter portion of the housing; and an annular collar mounted over the bent first ends of the contact strips to stationarily fix the first ends of the contact strips to the reduced diameter portion of the housing.

32. The electrical connector of claim 29 further comprising:

the housing formed with a substantially constant diameter between the first and second ends of the bore;

the first ends of the contact strips bent over the first end of the housing; and a collar fixed over the first ends of the contact strips to fix the first ends of the contact strips to the housing.

33. The electrical connector of claim 29 further comprising:

the contact strips formed as U-shaped separate members, each with an end leg joined between one end of two spaced side legs;

the end legs of each of a plurality of contact strips overlaid and the contact strips angularly offset to circumferentially space the side legs of adjacent contact strips; and the end legs of the contact strips fixed together.

34. The electrical connector of claim 33 further comprising:

the overlaid end legs of the contact strips welded together.

35. The electrical connector of claim 29 further comprising:

the contact strips formed as individual members having opposed first and second ends; and one end of the contact strips fixed to the member in a circumferentially spaced orientation.

36. An electrical connector for connecting first and second conductive elements, the electrical connector comprising:

a housing having a bore extending from a first end of the housing to a second end;

a contact formed of a plurality of elongated contact strips mounted in the bore in the housing through the first end, the contact having first and second ends wherein the first and second ends are angularly offset to form each contact strip in a hyperbolic shape between the first and second ends of the contact;

a radially inward extending detent formed in at least one of the contact strips, the detent extending toward an opposed contact strip;

an annular recess formed in a conductive member adapted for insertion into the bore in the housing to bring the at least one detent in releasable contact with the annular recess to releasably retain the conductive member in the housing; and external end anchor means for fixedly connecting the first end of the contact to the first end of the housing; and internal anchor means for fixedly connecting the second end of the contact internally within the bore of the housing.

37. The electrical connector of claim 36 wherein the detent further comprises:

a plurality of annularly aligned detents formed in a plurality of the contact strips.

38. The electrical connector of claim 36 wherein:

the at least one detent has an arcuate shape.

39. The electrical connector of claim 36 wherein:

the detent has a ramp shape.

40. An electrical connector for connecting first and second conductive elements, the electrical connector comprising:

a housing having a bore extending from a first end of the housing to a second end;

a contact formed of a plurality of elongated contact strips mounted in the bore in the housing through the first end, the contact having first and second ends wherein the first and second ends are angularly offset to form each contact strip in a hyperbolic shape between the first and second ends of the contact;

external end anchor means for fixedly connecting the first end of the contact to the first end of the housing; and internal anchor means for fixedly connecting the second end of the contact internally within the bore of the housing.

at least one louver formed in a sidewall of the housing surrounding the bore, the at least one louver having a first end contiguous with the sidewall of the housing and an opposed second end disposed in the bore in the housing and spaced form the sidewall of the housing, the free end of the louver defining an aperture in the sidewall of the housing, one of the first and second ends of one of the contact strips being disposed in the aperture in the sidewall of the housing, the louver being forced into the aperture in the housing to fixedly electrically engage the one of the first and second ends of the contact strips in electrical contact with the sidewall of the housing.

41. The electrical connector of claim 40 wherein:

the louver has a contiguous generally planar form between the first and second ends.

42. The electrical connector of claim 40 wherein the at least one louver further comprises:

a plurality of louvers formed in the sidewall of the housing, each louver substantially identically constructed and arranged in at least one annular band about the sidewall of the housing, each louver adapted for receiving one end of the first and second ends of the contact strips.

43. The electrical connector of claim 42 wherein:

the plurality of louvers are disposed in at least two axially spaced, annular bands in the sidewall of the housing.

44. The electrical connector of claim 40 wherein the louver comprises:

a flange spaced from the sidewall of the housing and connected to the housing by two side legs extending contiguously from the sidewall of the housing to the flange;

one of the first and second ends of one of the contact strips disposed between the flange of the louver and an aperture defined by the flange in the sidewall of the housing; and the flange disposed into the aperture in the sidewall of the housing to fixedly electrically engage one of the first and second ends of the contact strip in electrical contact with the sidewall of the housing.

45. The electrical connector of claim 40 wherein the louver further comprises:

a flange joined at opposed sides to the sidewall of the housing, the flange having opposed first and second ends disposed oppositely and angularly with respect to the sidewall of the housing, the first and second ends of the flange defining opposed first and second apertures in the sidewall of the housing separated by the flange;

the ends of two contact strips disposed in the first and second opposed apertures; and the flange disposed in registry with the sidewall of the housing closing the first and second apertures and fixedly electrically connecting the ends of the two contact strips to the housing.

* * * * *

UNITED STATES PATENT AND TRADEMARK OFFICE

CERTIFICATE OF CORRECTION

PATENT NO. : 7,048,596 B2
APPLICATION NO. : 10/274202
DATED : May 23, 2006
INVENTOR(S) : Dean D. Swearingen et al.

It is certified that error appears in the above-identified patent and that said Letters Patent is hereby corrected as shown below:

On the Title Page, Item (56) under "U.S. PATENT DOCUMENTS:
please correct the issue date for patent number 3,470,527, the correct date is: --6/1966--;

and please correct the issue date for patent number 4,720,157, the correct date is: --1/1998--.

Col. 15, line 28, change "electroplating" to --electro-plating--.

Col. 18, claim 7, line 65, please change "38" to --1--.

Col. 23, claim 40, line 23, please change "." to --,--.

Signed and Sealed this

Fourteenth Day of September, 2010

David J. Kappos

David J. Kappos
*Director of the United States Patent and Trademark Office*